US008243104B2

(12) United States Patent
Someya et al.

(10) Patent No.: US 8,243,104 B2
(45) Date of Patent: Aug. 14, 2012

(54) IMAGE DISPLAY APPARATUS AND METHOD

(75) Inventors: Jun Someya, Tokyo (JP); Shuichi Kagawa, Tokyo (JP); Hideki Yoshii, Tokyo (JP); Hiroaki Sugiura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1596 days.

(21) Appl. No.: 11/631,934

(22) PCT Filed: Aug. 8, 2005

(86) PCT No.: PCT/JP2005/014519

§ 371 (c)(1),
(2), (4) Date: Jan. 9, 2007

(87) PCT Pub. No.: WO2006/025190

PCT Pub. Date: Sep. 3, 2006

(65) Prior Publication Data

US 2007/0247391 A1 Oct. 25, 2007

(30) Foreign Application Priority Data

Sep. 1, 2004 (JP) ..... 2004-254497

(51) Int. Cl.
*G09G 5/10* (2006.01)

(52) U.S. Cl. ..... 345/690; 345/77; 345/87; 382/167; 358/518

(58) Field of Classification Search ..... 345/7, 102, 345/204, 214, 46–48, 87–100; 382/162, 382/167; 358/518, 520
See application file for complete search history.

(56) References Cited

U.S. PATENT DOCUMENTS

| | | | | |
|---|---|---|---|---|
| 5,748,257 | A | 5/1998 | Kawabata et al. | |
| 7,202,850 | B2 * | 4/2007 | Kitagawa | 345/102 |
| 7,505,026 | B2 * | 3/2009 | Baba et al. | 345/102 |
| 7,839,418 | B2 * | 11/2010 | Kwon | 345/604 |
| 8,090,198 | B2 * | 1/2012 | Yoshii et al. | 382/167 |
| 2004/0104877 | A1 | 6/2004 | Kitagawa | |
| 2005/0184998 | A1 | 8/2005 | Yang et al. | |
| 2006/0274212 | A1 * | 12/2006 | Lo et al. | 348/650 |

FOREIGN PATENT DOCUMENTS

| | | | |
|---|---|---|---|
| JP | 5-224641 | A | 9/1993 |
| JP | 7-288751 | A | 10/1995 |
| JP | 2000-75838 | A | 3/2000 |
| JP | 3215388 | B2 | 7/2001 |
| JP | 2002-182634 | A | 6/2002 |
| JP | 3430998 | B2 | 5/2003 |
| JP | 2004-191950 | A | 7/2004 |
| JP | 2005-242300 | A | 9/2005 |

* cited by examiner

*Primary Examiner* — William Boddie
*Assistant Examiner* — Mansour M Said
(74) *Attorney, Agent, or Firm* — Birch, Stewart. Kolasch & Birch, LLP

(57) ABSTRACT

An image display device and an image display method are provided so as to suppress consumption power and provide a more brightly colored display image. The image display device is provided with a light modulating means wherein image data is inputted and an image is formed by modulating light from a light source based on the image data. The image display device is also provided with a color information detecting means for detecting a quantity of a chromatic color component of an image expressed by the image data; a light source control data generating means for generating light source control data for controlling brightness of the light source; and a light source control means for controlling the brightness of the light source based on the light source control data.

17 Claims, 23 Drawing Sheets

IMAGE DISPLAY APPARATUS AND METHOD

FIELD OF THE INVENTION

The present invention relates to an image display apparatus and an image display method, and in particular to the adjustment of brightness, image data, etc. according to an input image signal.

BACKGROUND ART

In a control scheme carried out in image display apparatus using light valves such as liquid crystal panels, the brightness of the backlight or other light source is adjusted responsive to the image signal. The image display apparatus disclosed in patent document 1 below adjusts the brightness of the light source responsive to changes in the DC level of the image so as not to change the average brightness level of the displayed image due to changes in the DC level of the image that occur when the contrast is adjusted. This scheme improves the contrast of the displayed image.

Patent document 1: Japanese Patent No. 3215388

DISCLOSURE OF THE INVENTION

Problems to be Solved by the Invention

By adjusting the brightness of the backlight light source responsive to the image signal, the image display apparatus disclosed in patent document 1 above gives a better sense of contrast. Other methods, such as increasing the color purity of the color filters, are used to display images with brighter colors. Use of color filters of higher color purity, however, reduces the wavelength bandwidth of the transmitted light (or reflected light), resulting in lowered transmittance (or reflectance). Accordingly, it is necessary to increase the brightness of the light source to obtain the desired display brightness, which poses problems such as increased power consumption.

An object of the present invention is to solve the above problems by providing an image display apparatus and image display method that can reduce power consumption and obtain displayed images with brighter colors.

Means of Solution of the Problems

An image display apparatus according to the present invention has a light modulation means for receiving image data and forming an image by modulating light from a light source according to the image data, and includes: a chromatic information detection means for detecting a magnitude of the chromatic component of an image expressed by the image data;

a light source control data generating means for generating light source control data for controlling brightness of the light source according to the magnitude of the chromatic component; and a light source control means for controlling the brightness of the light source according to the light source control data.

An image display method according to the present invention includes receiving image data and forming an image by modulating light from a light source according to the image data, and comprises the steps of detecting a magnitude of a chromatic component of an image expressed by the image data and generating light source control data for controlling the brightness of the light source according to the magnitude of the chromatic component, and controls the brightness of the light source according to the light source control data.

Effect of the Invention

By adjusting the brightness of the image according to the magnitude of its chromatic component, the image display apparatus and image display method according to the present invention can obtain vividly colorful displayed images by brightly displaying images with highly saturated colors.

BEST MODE OF PRACTICING THE INVENTION

First Embodiment

FIG. 1 is a block diagram showing the structure of an image display apparatus according to an embodiment of the present invention. The image display apparatus shown in FIG. 1 comprises a receiving unit 2, a chromatic information detection unit 3, a light source control data generating unit 4, a light source control unit 5, a modulating unit 6, and a light source 7. The modulating unit 6 comprises a display device that modulates light from the light source 7 to form an image. Specifically, it may comprise a liquid crystal panel, a projector using a liquid crystal panel, or a projector using a reflective light valve (DMD) furnished with miniature mirror elements corresponding to the pixels, etc.

The receiving unit 2 receives an image signal having a predetermined format used in television, computers, etc. through an input terminal 1, converts the received image signal to image data comprising red, green, and blue color data, and outputs the red, green, and blue color data. If an analog image signal is input, the receiving unit 2 includes an analog-to-digital converter; if a modulated image signal is input, the receiving unit 2 includes a corresponding demodulator.

The image data output from the receiving unit 2 are input to the chromatic information detection unit 3 and modulating unit 6. The chromatic information detection unit 3 detects the magnitude of the chromatic component of the image data one screen (one frame) at a time, and outputs the magnitude to the light source control data generating unit 4.

FIG. 2 is a block diagram showing the internal structure of the chromatic information detection unit 3. The chromatic information detection unit 3 shown in FIG. 2 comprises a maximum value detection unit 8, a minimum value detection unit 9, a subtractor 10, and a mean value calculation unit 11. For each pixel, the maximum value detection unit 8 detects the maximum value of the red (R), green (G), and blue (B) color data constituting the image data and outputs it as maximum value data. The minimum value detection unit 9 detects the minimum value of the red, green, and blue color data constituting the image data and outputs it as minimum value data, for each pixel. The minimum value data represent the magnitude of the achromatic component in the image data. The maximum value data and the minimum value data output from the maximum value detection unit 8 and the minimum value detection unit 9 are sent to the subtractor 10. The subtractor 10 subtracts the minimum value from the maximum value to calculate the magnitude of the chromatic component in each pixel. The chromatic component relates to the saturation of the image data. Generally speaking, the greater the magnitude of the chromatic component is, the higher the saturation of the image will be.

The magnitude of the chromatic component in each pixel output from the subtractor 10 is input to the mean value calculation unit 11. The mean value calculation unit 11 calculates the mean value of the chromatic component of the pixels in one frame as chromatic data CHR that represents the magnitude of the chromatic component in the frame. The chromatic data CHR calculated by the mean value calculation unit 11 are sent to the light source control data generating unit 4. On the basis of the chromatic data CHR, the light source control data generating unit 4 outputs light source control data k to be used in displaying the frame. The light source control data k are used for driving the light source 7. The light source 7 is controlled so as to emit brighter light as the value of the light source data k increases.

FIG. 3 shows an example of the relation between the chromatic data CHR and the light source control data k. The chromatic data CHR are compared with two threshold values SH0 and SH1; the value of the light source control data k is 1 when CHR is less than SH0, is x when CHR is greater than SH1, and varies from 1 to x when SH0≦CHR≦SH1. When the value of k is 1, the light source 7 is driven to emit light with a standard brightness, and when k is greater than 1, the light source 7 is driven to emit light brighter than the standard brightness. When the value of the light source control data is x, the light source 7 is driven to emit light of maximum brightness. Any brightness may be employed, provided that when the magnitude of the chromatic component is greater than threshold SH1, the light source 7 emits light brighter than the standard brightness.

The light source control data k generated by the light source control data generating unit 4 are sent to the light source control unit 5. The light source control unit 5 controls the brightness of the light source 7 by adjusting its driving current, the number of driving voltage pulses (pulse frequency), or the pulse width according to the light source control data k.

The modulating unit 6 generates a displayed image by modulating the light from the light source 7 according to the image data output from the receiving unit 2.

FIGS. 4(*a*) and 4(*b*) illustrate an effect of the image display apparatus shown in FIG. 1. FIG. 4(*a*) shows the color reproduction range of a conventional image display apparatus; FIG. 4(*b*) shows the color reproduction range when processing is carried out according to the present invention. In the image display apparatus according to the invention, the brightness of the light source 7 is controlled in accordance with the light source control data k generated according to the relation shown in FIG. 3. Therefore, when the magnitude of the chromatic component is high, the brightness of the light increases correspondingly. The result, indicated by the solid line in FIG. 4(*b*), is that the high saturation region is displayed with brighter light, so that the perceived gamut of colors reproduced in the displayed image is expanded. An image containing pure colors such as red, green, blue, cyan, magenta, and yellow, that is, an image having in which the chromatic component has a high magnitude, is thereby displayed brightly on the display.

It is empirically known that the brighter the image on the display is, the more vividly the image is perceived. Also, even for same color, the perceived saturation changes when the brightness changes. This phenomenon is known as the Hunt effect. On the other hand, in an image having little chromatic content such as a black and white image, the mean perceived brightness level does not change. Therefore, by increasing the brightness of the light source responsive to the saturation of the colors in an image, the difference in the brightness between black and white images and pure color images can be increased, so that vividly colorful displayed images can be obtained.

FIG. 5 is a flowchart illustrating the operation of the image display apparatus according to the present embodiment of the invention described above. First, image data are received (ST1), and the magnitude of the chromatic component of one frame of the received image data is detected as color information (ST2). Next, light source control data are generated from the detected color information (ST3), and the brightness of the light source is controlled according to the generated light source control data (ST4). Finally, the light from the light source with brightness adjusted according to the light source control data is modulated pixel by pixel to display an image (ST5).

As described above, the image display apparatus in the present invention controls the brightness of the light source according to the magnitude of the chromatic component (the saturation) of the displayed image. More specifically, it operates the light source at an average brightness level when the chromatic component is small, and increases the brightness of the light source when the chromatic component is large. It thereby displays highly saturated colors brightly, which can increase the perceived range of color reproduction. Increasing the perceived brightness difference between black and white images and pure color images can also produce more vividly colorful displayed images.

Since vivid colors can be displayed in the image without increasing the purity of the color filters used in the modulating device, this effect is obtained with less increase in power consumption by the light source.

In the description above, the chromatic information detection unit 3 obtained the chromatic data CHR by averaging the difference between the maximum and minimum values of the red, green, and blue color data, but other methods may be used instead.

FIG. 6 is a block diagram showing an alternative structure of the chromatic information detection unit. The chromatic information detection unit 3 shown in FIG. 6 has a histogram calculation unit 12. The magnitude of the chromatic component of each pixel calculated by the 10 is input to the histogram calculation unit 12. The histogram calculation unit 12 calculates a histogram of the chromatic component in one frame, and calculates chromatic component data CHR from the histogram for output to the light source control data generating unit 4. More specifically, the histogram calculation unit 12 obtains the maximum value, or a value close to the maximum value, of the chromatic component from the histogram for one frame, or a value representing the midway point of the histogram (the so-called median value), for use as the chromatic component data. Alternatively, the mean value of the chromatic component may be obtained from the histogram.

The light source control data k may be calculated from the mean value of the chromatic component data CHR over a plurality of frames. Alternatively, the mean value (integral term) of the chromatic component data CHR for the plurality of frames and the chromatic component data (proportional term) for one frame may be added in an appropriate ratio to establish a time constant for change in the light source control data k. By establishing a time constant as above, abrupt changes in the brightness of the light source 7 can be avoided, and smoother brightness variations can be obtained. The chromatic component data CHR may be calculated from pixels in a certain area in the displayed image.

FIG. 7 is a block diagram showing another alternative structure of the chromatic information detection unit. The chromatic information detection unit 3 shown in FIG. 7 comprises a pair of histogram calculation units 37 and 38 and a histogram comparison unit 39. The maximum data output from the maximum value detection unit 8 are sent to histogram calculation unit 37; the minimum data output from the minimum value detection unit 9 are sent to histogram calculation unit 38. The histogram calculation units 37 and 38 calculate histograms of the maximum data and the minimum data for one frame. The histograms of the maximum data and the minimum data calculated by the histogram calculation units 37 and 38 are sent to the histogram comparison unit 39.

The chromatic component of a frame is large when the histogram of the maximum value data is concentrated in the upper part of the gradation scale and the histogram of the minimum value data is concentrated in the lower part of the gradation scale, and is small when the maximum and minimum data have similar histograms. Therefore, the magnitude of the chromatic component for one frame can be calculated from a comparison between the histogram of the maximum data and the histogram of the minimum data. The histogram comparison unit 39 calculates the magnitude of the chromatic component for one frame by comparing the histogram of the maximum data and the histogram of the minimum data, and outputs the chromatic component data CHR.

Alternatively, the cumulative frequency of the maximum data may be calculated from the high end of the gradation scale, and compared with a first preset threshold to obtain the number of gradation levels exceeding the threshold as the maximum gradation data. Then the cumulative frequency of the minimum data may be calculated from the low end of the gradation scale and compared with a second preset threshold to obtain the number of gradation levels exceeding the threshold as the minimum gradation data. The difference between the maximum gradation data and the minimum gradation data may then be used as the chromatic component data CHR. Alternatively, the maximum gradation data and the minimum gradation data may be calculated without using thresholds.

Alternatively, the mean value of the maximum data may be calculated by using the histogram of the maximum data, the mean value of the minimum data may be calculated by using the histogram of the minimum data, and the magnitude of the chromatic component may be obtained from the difference between these two mean values.

FIG. 8 is a block diagram showing another alternative structure of the chromatic information detection unit. The chromatic information detection unit 3 shown in FIG. 8 comprises a pair of mean value calculation units 40 and 41 and a mean value comparison unit 42. Mean value calculation unit 40 calculates the mean value of the maximum data for one frame output from the maximum value detection unit 8. Mean value calculation unit 41 calculates a mean value of the minimum data for one frame output from the minimum value detection unit 9. The mean values of the maximum data and the minimum data are sent to the mean value comparison unit 42. The mean value comparison unit 42 calculates the difference between the mean value of the maximum data and the mean value of the minimum data to obtain the magnitude of the chromatic component in one frame, and outputs it as the chromatic component data CHR.

FIG. 9 is a block diagram showing an alternative structure of the image display apparatus shown in FIG. 1. The image display apparatus shown in FIG. 9 further comprises a region signal generating unit 13. The region signal generating unit 13 generates a region specification signal s that specifies a certain region in the displayed image according to the vertical synchronizing signal and horizontal synchronizing signal of the image data, and outputs the generated signal s to the chromatic information detection unit 14. The chromatic information detection unit 14 generates the chromatic component data CHR from the magnitude of the chromatic component in the region specified by the region specification signal s. Other operations are similar to those of the image display apparatus shown in FIG. 1.

By calculating chromatic component data CHR in the specific region based on the region specification signal s, the brightness can be adjusted more appropriately according to the magnitude of the chromatic component in the region where viewers concentrate their attention, such as the center of the screen. When a movie stored on DVD is reproduced, the magnitude of the chromatic component can be detected so as to exclude the black belts shown at the top and bottom of the screen for captions. Thus, the brightness can be controlled appropriately according to the content of the image.

The region signal generating unit 13 may detect a region having a specific brightness or a specific color, and output a signal specifying the detected region as a region specification signal s.

FIG. 10 is a block diagram showing another alternative structure of the image display apparatus shown in FIG. 1. The image display apparatus shown in FIG. 10 further comprises an OSD signal receiving unit 16 and an image combining unit 17. The OSD signal receiving unit 16 receives an image signal (OSD signal) describing text or graphics generated outside the image display apparatus, outputs the text information expressed by the received OSD signal to the image combining unit 17, generates a region specification signal s specifying a region other than the part where the text image is to be displayed, and outputs this signal s to the chromatic information detection unit 14.

The image combining unit 17 combines the text information expressed by the OSD signal and the image data output from the receiving unit 2 to generate a new image. Red, green, and blue color data representing the image generated by the image combining unit 17 are sent to the chromatic information detection unit 14 and modulating unit 6. The chromatic information detection unit 14 detects the magnitude of the chromatic component in the region outside of the part where the text information is displayed, according to the region specification signal output from the OSD signal receiving unit 16. Other operations are similar to those of the image display apparatus of FIG. 1.

Because the magnitude of the chromatic component is detected as described above in a region outside the OSD signal, the brightness of the light source 7 can be appropriately adjusted without being affected by the text information superimposed by the OSD signal on the displayed image.

FIG. 11 is a block diagram showing an alternative structure of the image display apparatus shown in FIG. 10. The image display apparatus shown in FIG. 11 comprises an OSD signal generating unit 18 that generates the OSD signal. The OSD signal generating unit 18 generates OSD signals that express symbols and characters shown to display the channel number or remote control operation information, and outputs these signals to the image combining unit 17. The OSD signal generating unit 18 also generates a region specification signal s that specifies a region outside the symbols and characters expressed by the OSD signal, and outputs this signal s to the chromatic information detection unit 14. Other operations are similar to those of the image display apparatus shown in FIG. 10.

When an image signal comprising a luminance signal and a chrominance signal is input to the receiving unit 2, negative values may appear when the image signal is converted to red, green, and blue color data. Negative red, green, and blue color data may also be generated in the receiving unit 2 by image processing such as image quality adjustment carried out on the red, green, and blue color data. Even if the minimum data have a negative value, however, the difference between the minimum data and the maximum data can still be considered to represent saturation. That is, even a negative minimum value can be treated as an achromatic component and used as minimum value data. The chromatic information detection unit 3 outputs the difference between the maximum data and the minimum data of the red, green, and blue color data detected by the maximum value detection unit 8 and minimum value detection unit 9 as the chromatic component data CHR as described above.

Second Embodiment

FIG. 12 is a block diagram showing another embodiment of an image display apparatus according to the present invention. FIG. 13 is a block diagram that shows the internal structure of the chromatic information detection unit 19 in the image display apparatus shown in FIG. 12. The chromatic information detection unit 19 shown in FIG. 13 comprises a minimum value detection unit 9, subtractors 21, 22, and 23, and mean value calculation units 24, 25, and 26.

The green, red, and blue color data constituting the image data are input to the subtractors 21, 22, 23, respectively, and are input collectively to the minimum value detection unit 9. The minimum value detection unit 9 detects the minimum value in the red, green, and blue color data and outputs it to the subtractors 21, 22, 23 as minimum data. Subtractor 21 subtracts the minimum data from the green color data, and outputs the result to mean value calculation unit 24 as data representing the magnitude of the green chromatic component. Similarly, subtractor 22 subtracts the minimum data from the red color and outputs the result to mean value calculation unit 25 as data representing the magnitude of the red chromatic component. Subtractor 23 subtracts the minimum data from the blue color data, and outputs the result to mean value calculation unit 26 as data representing the magnitude of the blue chromatic component. The magnitude of at least one of the three chromatic components (red, green, and blue) of each pixel is zero.

The mean value calculation units 24, 25, 26 calculate the mean values of the chromatic components in one frame to obtain chromatic component data Ga, Ra, Ba representing the magnitude of the chromatic component in the frame, and output these data to the light source control data generating unit 20 in FIG. 13.

FIG. 14 is a block diagram showing the internal structure of the light source control data generating unit 20. The light source control data generating unit 20 shown in FIG. 14 comprises data generating units 27, 28, 29 and a data selection unit 30. The data generating units 27, 28, 29 generate light source control data Gk, Rk, Bk based on the chromatic component data Ga, Ra, Ba.

FIGS. 15(*a*) to 15(*c*) show the relation between the chromatic component data Ga, Ra, Ba and the light source control data Gk, Rk, Bk. The chromatic component data Gk, Rk, and Bk for green, red, and blue are compared with two sets of preset threshold values SHg0, SHg1, Shr0, SHr1, and SHb0, SHb1. These threshold values are related so that SHg0>SHr0>SHb0, and SHg1>SHr1>SHb1.

As shown in FIG. 15(*a*), the value of the light source control data Gk is 1 when the chromatic component data Gk is less than SHg0, is x1 when the chromatic component data Gk is greater than SHg1, and varies from 1 to x1 when SHg0≦Gk≦SH1. As shown in FIGS. 15(*b*) and 15(*c*), the values of the light source control data Rk and Bk are 1 when the chromatic component data Rk and Bk are less than SHr0 and SHb0, respectively, and are x2 and x3 when the chromatic component data Rk and Bk are greater than SHr1 and SHb1, respectively. The light source control data Rk and Bk take values between 1 and x2 and between 1 and x3, respectively, when the chromatic component data Rk and Bk are in the ranges SHr0≦Rk≦SHr1 and SHb0≦Bk≦SHb1, respectively. The x1, x2, x3 values in the light control data are related so that x1<x2<x3.

The light control data Gk, Rk, Bk are input to the data selection unit 30. The data selection unit 30 selects the maximum value from among the light control data Gk, Rk, Bk, and outputs the selected value to the light source control unit 5 in FIG. 12. The light source control unit 5 controls the brightness of the light source 7 according to the selected light source control data.

The sensitivity of human vision to brightness is greater for green than for red, and greater than red than for blue, which is why the maximum values x1, x2, x3 of the light source control data Gk, Rk, Bk are chosen to satisfy the relation x1<x2<x3. The threshold relations SHg0>SHr0>SHb0, and SHg1>SHr1>SHb1 also enable brightness to be appropriately adjusted according to the sensitivity of human vision.

It is also possible to set light source control data not only for the three primary colors red, green, and blue but also for their complementary colors cyan, magenta, and yellow to set the appropriate brightness for the color of the image.

The characteristics of the light source control data Gk, Rk, Bk shown in FIG. 15(*a*) to FIG. 15(*c*) are only one example; other characteristics can be set as appropriate. For example, the maximum value x3 of the light source control data Bk may have any value that makes the brightness of the light source 7 higher than the standard brightness.

FIG. 16 is a block diagram showing another possible structure of the light source control data generating unit 20 in the image display apparatus shown in FIG. 12. The light source control data generating unit 20 shown in FIG. 16 comprises a maximum value detection unit 31. The other structural elements are similar to those in the light source control data generating unit 20 shown in FIG. 14.

The maximum value detection unit 31 selects the data having highest value from among the chromatic component data Ga, Ra, Ba calculated by the chromatic information detection unit 19, generates a light source control data selection signal that specifies the brightness control data corresponding to the selected chromatic component data, and outputs the generated signal to the data selection unit 32. The data selection unit 32 selects and outputs the light source control data Gk, Rk, Bk specified by the light source control data selection signal output from the maximum value detection unit 31.

Thus, the apparatus has a structure where the light source control data Gk, Rk, Bk are selected according to the magnitude relations among the chromatic component data Ga, Ra, Ba, and the adjustment of the brightness of the light source 7 is based on the actually detected magnitude of the chromatic component of each color. With this configuration, the light source control data Gk, Rk, Bk can be selected accurately, and the light source control data can be set flexibly.

Third Embodiment

FIG. 17 is a block diagram showing another embodiment of an image display apparatus according to the present invention. FIG. 18 is a block diagram showing the internal structure of the chromatic information detection unit 33 in the image display apparatus shown in FIG. 17. The chromatic information detection unit 33 shown in FIG. 18 comprises a maximum value detection unit 8, a minimum value detection unit 9, a subtractor 10, a mean value calculation unit 11, and a histogram calculation unit 35.

The red, green, and blue color data constituting the image data are input to the maximum value detection unit 8, minimum value detection unit 9, and histogram calculation unit 35. For each pixel, the maximum value detection unit 8 detects the maximum value among the red, green, and blue color data values and outputs it as maximum value data. The minimum value detection unit 9 detects the minimum value among the red, green, and blue color data values and outputs it as minimum value data. The subtractor 10 subtracts the minimum data from the maximum data to calculate the magnitude of the chromatic component of each pixel. The mean value calculation unit 11 calculates the mean value of the magnitudes of the chromatic components of the pixels in one frame, and outputs it as the chromatic component data CHR representing the magnitude of the chromatic component in the frame. The chromatic component data CHR calculated by the mean value calculation unit 11 are sent to the light source control data generating unit 34. The histogram calculation unit 35 calculates a histogram of the red, green, and blue color data, and sends histogram data HD representing the calculated histogram to the light source control data generating unit 34.

FIG. 19 is a block diagram showing the internal structure of the light source control data generating unit 34. The light source control data generating unit 34 shown in FIG. 19 comprises data generating units 27, 28, 29 and a data processing unit 36. The chromatic component data CHR output from the chromatic information detection unit 33 are input to the data generating units 27, 28, 29, and the histogram data HD are input to the data processing unit 36. The data generating units 27, 28, 29 output light source control data Gk, Rk, Bk with values that are preset according to the chromatic component data CHR, and sends them to the data processing unit 36. The characteristics of the light source control data Rk, Gk, Bk can be based on the relation shown in FIG. 15.

The data processing unit 36 generates light source control data by selecting or processing the light source control data Gk, Rk, Bk according to the histogram data HD that represent the histogram of the red, green, and blue color data. Specifically, it calculates the chromatic components of colors having strong chromatic components, such as, for example, the chromatic components of the three primary colors of light, red, green, and blue, and their complementary colors cyan, magenta, and yellow. On the basis of the ratios between these values, it then selects and outputs one or two of the light source control data values Gk, Rk, Bk. Finally, it multiplies the selected light source control data by coefficients corresponding to the chromatic component ratios of the colors, and outputs the result. For example, when the histogram indicates a high saturation of red and green, the data processing unit 36 selects the light source control data Gk and Rk and performs a multiply-add operation thereon on the basis of the histogram distribution to obtain the light source control data k.

The light source control data k generated by the data processing unit 36 are sent to the light source control unit 5. The light source control unit 5 controls the brightness of the light source 7 according to the light source control data.

In this structure, the brightness of the light source 7 can be set differently for each chromatic component: for example, for the three primary colors red, green, and blue of light and their complementary colors cyan, magenta. Therefore, the brightness can be set appropriately according to the ratio of the chromatic components in one screen.

In the above description, the data processing unit 36 selects or processes the light source control data Gk, Rk, Bk according to the histogram of red, green, and blue. However, the invention is not limited to this scheme; instead, the light source control data k may be obtained from a calculation performed on the light source control data Gk, Rk, Bk. For example, coefficients set according to the histogram data HD for each of the light source control data may be added to the light source control data Gk, Rk, Bk.

Fourth Embodiment

FIG. 20 is a block diagram showing another embodiment of an image display apparatus according to the present invention. The image display apparatus shown in FIG. 20 comprises a receiving unit 2, a light source control data generating unit 4, a chromatic information detection unit 43, an image control data generating unit 44, an image control unit 45, a light source control unit 5, a modulating unit 6, and a light source 7.

Image data output from the receiving unit 2 are input to the chromatic information detection unit 43 and the image control unit 45. The chromatic information detection unit 43 detects the magnitude of the chromatic component in one frame of the image data, and sends the detected magnitude of the chromatic component as the chromatic component data CHR to the light source control data generating unit 4. The light source control data generating unit 4 outputs light source control data k based on the chromatic component data CHR. The light source control data k are sent to the light source control unit 5 and the image control data generating unit 44. The light source control unit 5 controls the brightness of the light source 7 according to the light source control data k.

The chromatic information detection unit 43 detects the magnitude of the chromatic component of each pixel in one frame, and outputs chromatic component data CHRp representing the detected magnitude of the chromatic component of each pixel to the image control data generating unit 44. On the basis of the chromatic component data CHRp and the light source control data k, for pixels having small chromatic components, the image control data generating unit 44 generates image control data j that cancel out the change in the brightness of the light source 7 caused by control based on the light source control data k.

FIG. 21 is a diagram showing the relation between the chromatic component data CHRp and the image control data j. As shown in FIG. 21, the chromatic component data CHRp are compared with two preset thresholds SH2 and SH3. The value of the light source control data j is y when the chromatic component data CHRp are less than threshold SH2, is 1 when the chromatic component data CHRp are greater than threshold SH3, and varies from 1 to y when SH2≦CHRp≦SH3. The value y of the control data is set so as to cancel out the change in the brightness of the light source 7 controlled according to the light source control data k. That is, the value y of the control data varies with the value k of the light source control data.

The image control data j are sent to the image control unit 45. The image control unit 45 modifies the gradation levels of each pixel in the image specified by the image data output from the receiving unit 2 according to the image control data j, and outputs the result to the modulating unit 6. In this process, the gradation levels of pixels having small chromatic components are adjusted so as to cancel out the brightness of the light source 7 controlled according to the light source control data k. The image control unit 45 may adjust the red, green, and blue image data directly, or it may convert the red, green, and blue data to luminance data and chrominance data, adjust the converted data, and then convert the data back to red, green, and blue data. The modulating unit 6 modulates the light from the light source 7 according to the image data adjusted by the image control unit 45 to form an image.

FIG. 22 is a diagram showing the color reproduction range of the image display apparatus according to the embodiment shown in FIG. 20. The dotted line in FIG. 22 represents the color reproduction range of a conventional image display apparatus. In the image display apparatus according to the present embodiment, when a frame has a large chromatic component, the brightness of the light source 7 is increased and the gradation levels in the image data of pixels having small chromatic components are modified so as to cancel out the brightness of the light source 7. Highly saturated pixels can thereby be vividly and brightly displayed, while low-saturation pixels are displayed with reduced brightness, so the color reproduction range is widened, as shown by the solid line in FIG. 22.

FIG. 23 is a flowchart illustrating the operation of an image display apparatus according to the present embodiment. First, image data are received (ST11), and the magnitude of the chromatic component of one frame of the received image data is detected as color information (ST12). Next, light source control data are generated from the detected color information (ST13), and the brightness of the light source is controlled according to the generated light source control data (ST14).

Image control data, more specifically image control data that cancel out the brightness of the light source controlled by the light source control data for pixels having small chromatic components are generated to modify the gradation levels of each pixel in the image data (ST15) according to the magnitudes of the chromatic components of the pixels detected in step ST12 and the light source control data generated in step ST13.

Next, the gradation levels of each pixel in the image data are modified according to the image control data generated in step ST15 (ST16). Finally, on the basis of the modified image data, an image is displayed (ST17) by modulating the light from the light source, the brightness of which is controlled in step ST14.

In the image display apparatus according to the present embodiment, as described above, when a frame has a large chromatic component, the brightness of the light source 7 is increased but the gradation levels of the image data for pixels with small chromatic components are modified so as to cancel out the brightness of the light source 7. Highly saturated pixels can therefore be vividly and brightly displayed, while low-saturation pixels are displayed with reduced brightness, so the color reproduction range can be widened, as shown by the solid line in FIG. 22.

When an image frame having a large chromatic component includes pixels with only a small chromatic component, the regions having large chromatic components are displayed vividly, and the pixels having small chromatic components are displayed without change in their average perceived brightness level. This scheme increases the difference in perceived brightness level between black and white pixels and pure color pixels, so that a more vivid perceived image can be obtained.

Since vivid colors can be displayed in the image without increasing the purity of the color filters used in the modulating device, this effect is obtained with less increase in power consumption by the light source.

Fifth Embodiment

FIG. 24 is a block diagram showing another embodiment of an image display apparatus according to the present invention. The image display apparatus shown in FIG. 24 comprises a receiving unit 2, a chromatic information detection unit 3, a light source control data generating unit 4, an image control data generating unit 47, an image control unit 48, a light source control unit 5, a modulating unit 6, and a light source 7.

The image data output from the receiving unit 2 are input to the chromatic information detection unit 3, the luminance information detection unit 46, and the image control unit 48. The chromatic information detection unit 3 detects the magnitude of the chromatic component in one frame of the image data, and sends the detected magnitude of the chromatic component to the light source control data generating unit 4 as the chromatic component data CHR. The light source control data generating unit 4 outputs light source control data k based on the chromatic component data CHR. The light source control data k are sent to the light source control unit 5 and the image control data generating unit 47. The light source control unit 5 controls the brightness of the light source 7 according to the light source control data k.

The luminance information detection unit 46 detects the magnitude of the luminance component of each pixel in one frame, and outputs luminance data Yp representing the detected magnitude of the luminance component of each pixel to the image control data generating unit 47. On the basis of the luminance data Yp and the light source control data k, for pixels having small luminance components, the image control data generating unit 47 generates image control data i that cancel out the change in the brightness of the light source light source 7 caused by control by the light source control data.

FIG. 25 shows an example of the relation between the luminance data Yp and the image control data i. As shown in FIG. 25, the luminance data Yp are compared with two preset threshold values SH4 and SH5; the value of the light source control data i is z when Yp is less than SH4, is 1 when Yp is greater than SH5, and varies from z to 1 when SH4≦Yp≦SH5. The value of the control data z is set so as to cancel out the change in the brightness of the light source 7 controlled according to the light source control data k. That is, the value z of the control data varies with the value of the light source control data k.

The image control data i are sent to the image control unit 48. On the basis of the image control data i, the image control unit 48 adjusts the gradation levels of each pixel in the image data output from the receiving unit 2, and outputs the result to the modulating unit 6. The gradation levels of pixels having small luminance components are adjusted so as to cancel out the change in brightness of the light source 7 due to control based on the light source control data k. The image control unit 48 may adjust the red, green, and blue image data directly, or it may convert the red, green, and blue data to luminance data and chrominance data, adjust the converted data, and then convert the data back to red, green, and blue data. The modulating unit 6 modulates the light from the light source 7 according to the image data adjusted by the image control unit 48 to form an image.

FIG. 26 is a diagram showing the color reproduction range of the image display apparatus according to the present embodiment. The dotted line in FIG. 26 represents the color reproduction range of a conventional image display apparatus. In the image display apparatus according to the present embodiment, when a frame has a large luminance component, the brightness of the light source 7 is increased and the gradation levels in the image data of pixels having small chromatic components are modified so as to cancel out the brightness of the light source 7. Highly saturated pixels can thereby be vividly and brightly displayed, while low-saturation pixels are displayed with reduced brightness, so the color reproduction range is widened, as shown by the solid line in FIG. 26.

FIG. 27 is a flowchart illustrating the operation of an image display apparatus according to the present embodiment of the invention. First, image data are received (ST21), and the magnitude of the chromatic component of one frame of the received image data is detected as color information (ST22). Next, light source control data are generated from the detected color information (ST23), and the brightness of the light source is controlled according to the generated light source control data (ST24).

The magnitude of the luminance component of the image data received in step ST21 is detected (ST25), and image control data, more specifically image control data that cancel out the brightness of the light source controlled by the light source control data for pixels having small chromatic components, are generated to modify the gradation levels of each pixel in the image data (ST26), on the basis of the detected magnitude of the luminance component of the pixel and the light source control data generated in step ST23.

Next, the gradation levels of each pixel in the image data are modified according to the image control data generated in step ST26 (ST27). Finally, on the basis of the modified image data, an image is displayed (ST28) by modulating the light from the light source, the brightness of which is controlled in step ST24.

In the image display apparatus according to the present embodiment, as described above, when a frame has a large luminance component, the brightness of the light source 7 is increased but the gradation levels of the image data for pixels with small chromatic components are modified so as to cancel out the brightness of the light source 7. Highly saturated pixels can therefore be vividly and brightly displayed, while low-saturation pixels are displayed with reduced brightness, so the color reproduction range can be widened, as shown by the solid line in FIG. 26. Particularly, the contrast in images having a large chromatic component can be improved by suppressing the increase in the brightness of dark pixels (brightened black).

When an image frame having a large chromatic component includes pixels with only a small luminance component, the regions having large chromatic components are displayed vividly, and the pixels having small luminance components are displayed without changing their perceived brightness level. This scheme increases the difference in perceived brightness level between black and white pixels and pure color pixels, so that a more vivid perceived image can be obtained.

Sixth Embodiment

FIG. 28 is a block diagram showing another embodiment of an image display apparatus according to the present invention. The image display apparatus shown in FIG. 28 comprises a receiving unit 2, a chromatic information detection unit 3, a light source control data generating unit 4, a light source control unit 5, modulating units 6 and 49, and a light source 7.

The image data output from the receiving unit 2 are input to the chromatic information detection unit 3 and modulating unit 6. The chromatic information detection unit 3 detects the magnitude of the chromatic component in one frame of the image data, and sends the detected magnitude of the chromatic component as the chromatic component data CHR to the light source control data generating unit 4. The light source control data generating unit 4 outputs light source control data k based on the chromatic component data CHR. The light source control data k are sent to the light source control unit 5. The light source control unit 5 inputs the light source control data k, and outputs control data to the modulating unit 49. The modulating unit 49 modulates the light emitted from the light source 7 according to the control data, to control the brightness of the light incident on the modulating unit 6. On the basis of the image data output from the receiving unit 2, the modulating unit 6 modulates the incident light, the brightness of which is adjusted by the modulating unit 49, to form an image.

Because the image display apparatus according to the present embodiment uses a modulating unit 49 to adjust the brightness of the light source 7, the brightness can be adjusted according to the chromatic component of an image using a light source having constant output brightness. In this scheme, when the magnitude of the chromatic component is small, the brightness of the light incident on the modulating unit 6 has an average level, and when the chromatic component is large, the brightness of the light is increased. Thus, highly saturated regions can be displayed more brightly and the perceived gamut of reproduced colors can be expanded. More vividly colorful displayed images can also be obtained by increasing the perceived brightness difference between black and white images and pure color images.

Since vivid colors can be displayed in an image without increasing the purity of the color filters used in the modulating device, it is also possible to reduce the increase in power consumption by the light source.

Seventh Embodiment

FIG. 29 is a block diagram showing another embodiment of an image display apparatus according to the present invention. The image display apparatus shown in FIG. 29 comprises a receiving unit 2, a chromatic information detection unit 3, a display control data generating unit 51, a display control unit 52, and a display unit 50. For the display unit 50, a display device of the self emission type, such as a plasma display panel (PDP), CRT, organic EL display, field emission display (FED), or LED display may be used.

The image data output from the receiving unit 2 are input into the chromatic information detection unit 3 and the display unit 50. The chromatic information detection unit 3 detects the magnitude of the chromatic component in one frame of the image data, and sends the detected magnitude of the chromatic component to the display control data generating unit 51 as the chromatic component data CHR. From the chromatic component data CHR, the display control data generating unit 51 generates display control data that control the brightness of the display unit 50 as a whole (average brightness level), and sends the generated data to the display control data generating unit 51. The display control data are generated so as to raise the brightness of the display unit 50 as a whole for an image having a large chromatic component in one frame.

The display control unit 52 controls the voltage or current supplied to the display unit 50 according to the display control data, to adjust the brightness of the display screen as a whole. When a pulse-controlled display device such as a PDP is used as the display unit 50, the number of voltage or current pulses in the display unit 50 (pulse frequency) or their duty cycle can be adjusted to adjust the brightness of the screen. The display unit 50 displays an image based on the image data output from the receiving unit 2.

In the image display apparatus according to the present embodiment, the brightness of the display unit 50 can be adjusted as a whole according to the magnitude of the chromatic component of one frame. Highly saturated regions can therefore be brightly displayed and the perceived range of color reproduction can be expanded. Also, the difference in brightness between black and white images and pure color images can be increased, so that vividly colorful displayed images can be obtained.

Eighth Embodiment

FIG. 30 is a block diagram showing another embodiment of an image display apparatus according to the present invention. The image display apparatus shown in FIG. 30 comprises a receiving unit 2, a chromatic information detection unit 53, an image control data generating unit 54, an image control unit 55, and a display unit 56. Any type of display device may be used as the display unit 56, such as an LED panel, a plasma display panel, or an organic EL display, as noted in the first and seventh embodiments.

The image data output from the receiving unit 2 are input to the chromatic information detection unit 53 and the image control unit 55. The chromatic information detection unit 53 detects the magnitude of the chromatic component in one frame of the image data and the magnitude of the chromatic component of each pixel, and outputs the detected magnitudes to the image control data generating unit 54. The image control data generating unit 54 generates image control data to modify the gradation levels of the image data according to the magnitudes of the chromatic components detected by the chromatic information detection unit 53. Specifically, when the chromatic component of a frame is large, the image control data are generated so as to modify the gradation levels so that pixels having large chromatic components can be displayed more brightly.

The image control data generated by the image control data generating unit 54 are sent to the image control unit 55. The image control unit 55 modifies the gradation levels of each pixel in the image data output from the receiving unit 2 according to the image control data. The display unit 56 displays an image based on the image data in which the gradation levels have been modified by the image control unit 55. Other operations are the same as in the first embodiment.

In the image display apparatus according to the present embodiment, when one frame has a large chromatic component, the gradation levels of the image data are modified so that pixels having large chromatic components are displayed brightly. Thus, as in the first embodiment, highly saturated regions can be brightly displayed and the perceived range of color reproduction can be expanded to obtain vividly displayed images. Also, the difference in brightness between black and white images and pure color images can be increased, so that vividly colorful displayed images can be obtained.

Ninth Embodiment

FIG. 31 is a block diagram showing another embodiment of an image display apparatus according to the present invention. The image display apparatus shown in FIG. 31 comprises a receiving unit 2, a chromatic information detection unit 3, a light source control data generating unit 4, a light source control unit 5, a data conversion unit 57, a modulating unit 6, and a light source 7. The operations of the elements other than the data conversion unit 57 are the same as in the first embodiment.

The data conversion unit 57 converts the gradation scale characteristic of the image data Din comprising red, green, and blue color data output from the receiving unit 2, and outputs the converted image data Dout. Particularly, when the image data Din exceed the range that can be expressed by the modulating unit 6 (for example, when the red, green, and blue color data include negative values, or exceed the maximum gradation level of the modulating unit 6), the data conversion unit 57 converts the data values of the image data Din so as to reproduce the original gradation changes of the image data Din.

FIGS. 32 and 33 show examples of data conversion curves that may be used in the data conversion unit 57. FIG. 32 illustrates a data conversion curve using a linear function, while FIG. 33 illustrates a curve using a higher order function. Even if the red, green, and blue color data in the image data Din have negative values, by using the conversion curves shown in FIGS. 32 and 33, the data conversion unit 57 can reproduce the gradation changes that occur in the negative red, green, and blue color data.

By providing a data conversion unit 57 as above, images represented by data having a wide color reproduction range can be displayed without collapse of the gradation scale.

The data conversion unit 57 may be constructed using a look-up table etc.

EXPLANATION OF REFERENCE CHARACTERS

Figure 1:
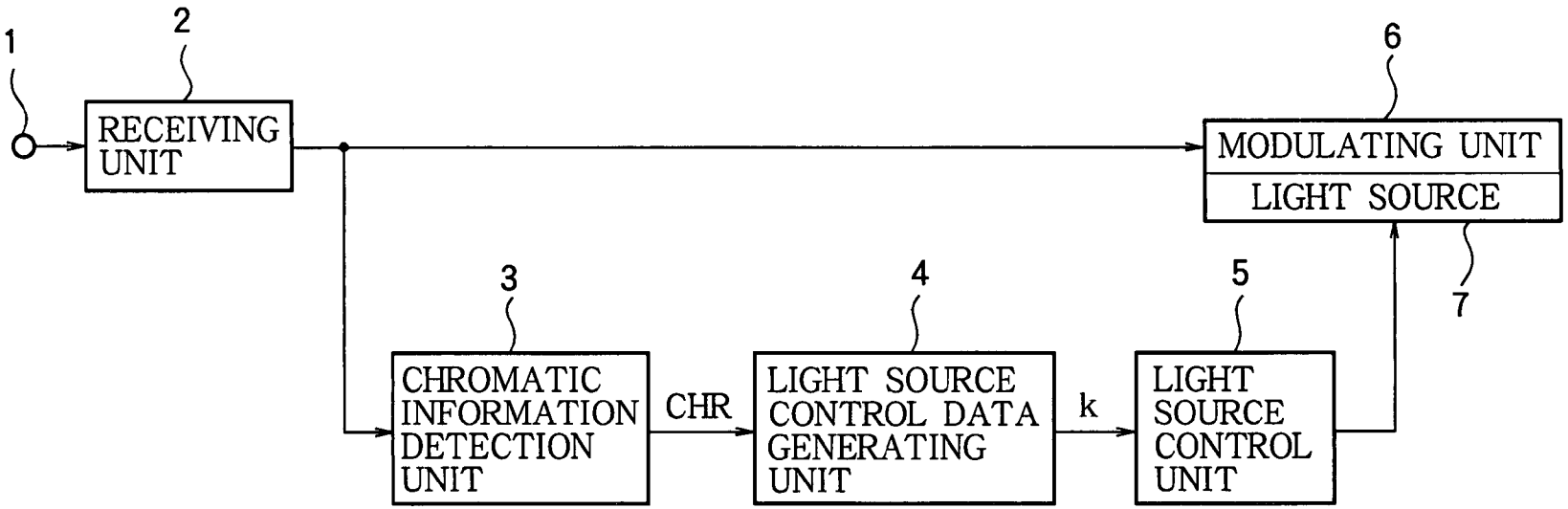
FIG. 1 is a block diagram showing the structure of an embodiment of an image display apparatus according to the present invention.
Figure 2:
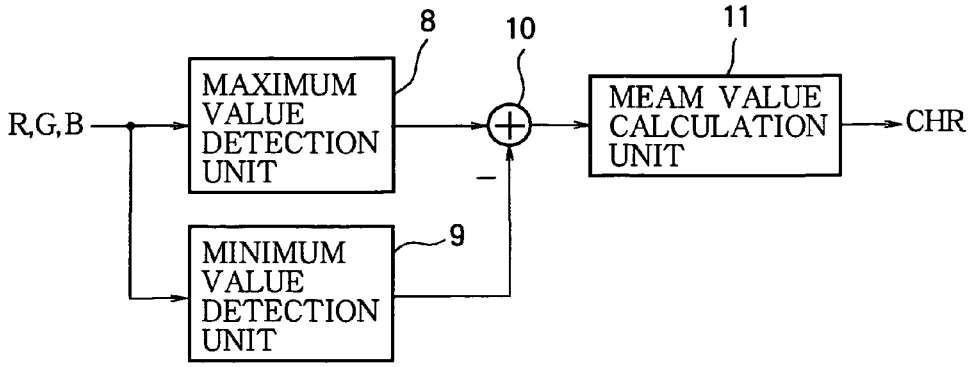
FIG. 2 is a block diagram showing the internal structure of the chromatic information detection unit.
Figure 3:
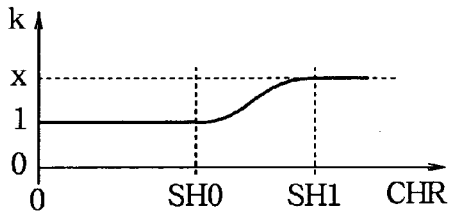
FIG. 3 shows an exemplary graph of brightness control data.
Figure 4:
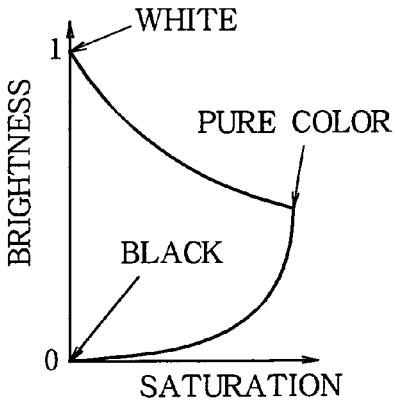
FIGS. 4(*a*) and 4(*b*) illustrate an effect of the image display apparatus according to the present invention.
Figure 4:
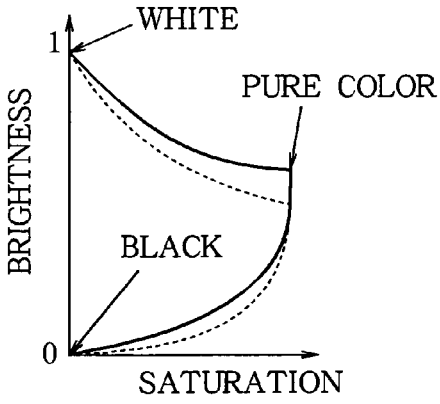
Figure 5:
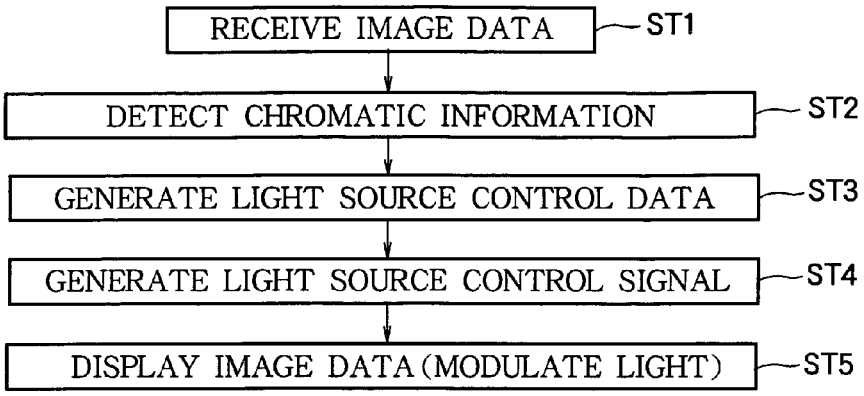
FIG. 5 is a flowchart showing processing in an image display apparatus according to the present invention.
Figure 6:
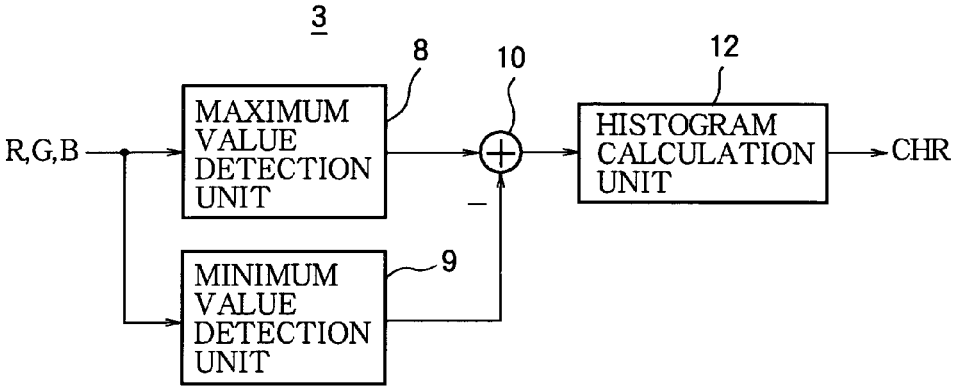
FIG. 6 is a block diagram showing an example of the internal structure of the chromatic information detection unit.
Figure 7:
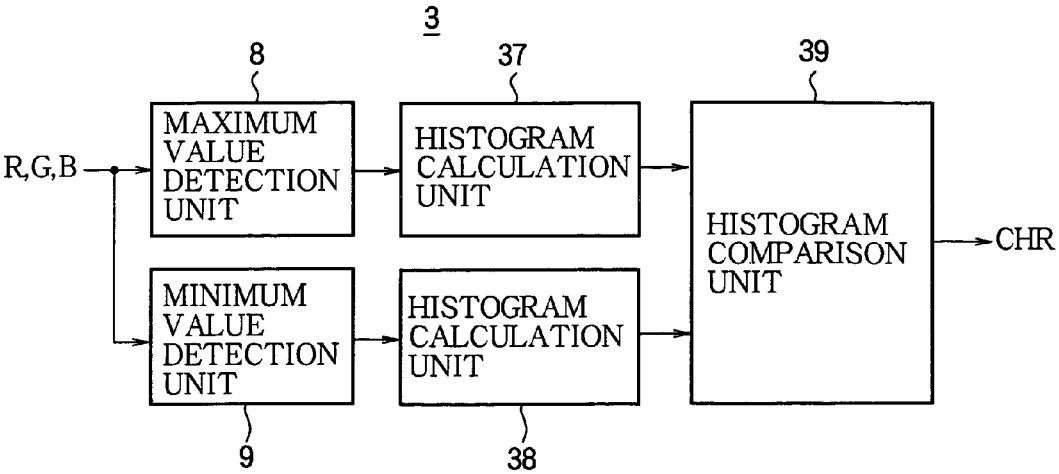
FIG. 7 is a block diagram showing an example of the internal structure of the chromatic information detection unit.
Figure 8:
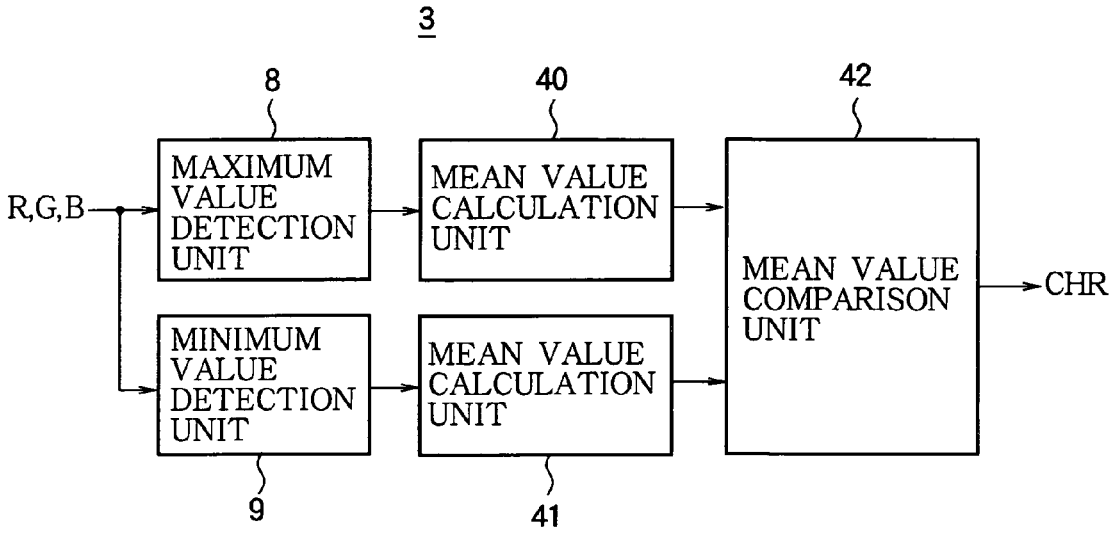
FIG. 8 is a block diagram showing an example of the internal structure of the chromatic information detection unit.
Figure 9:
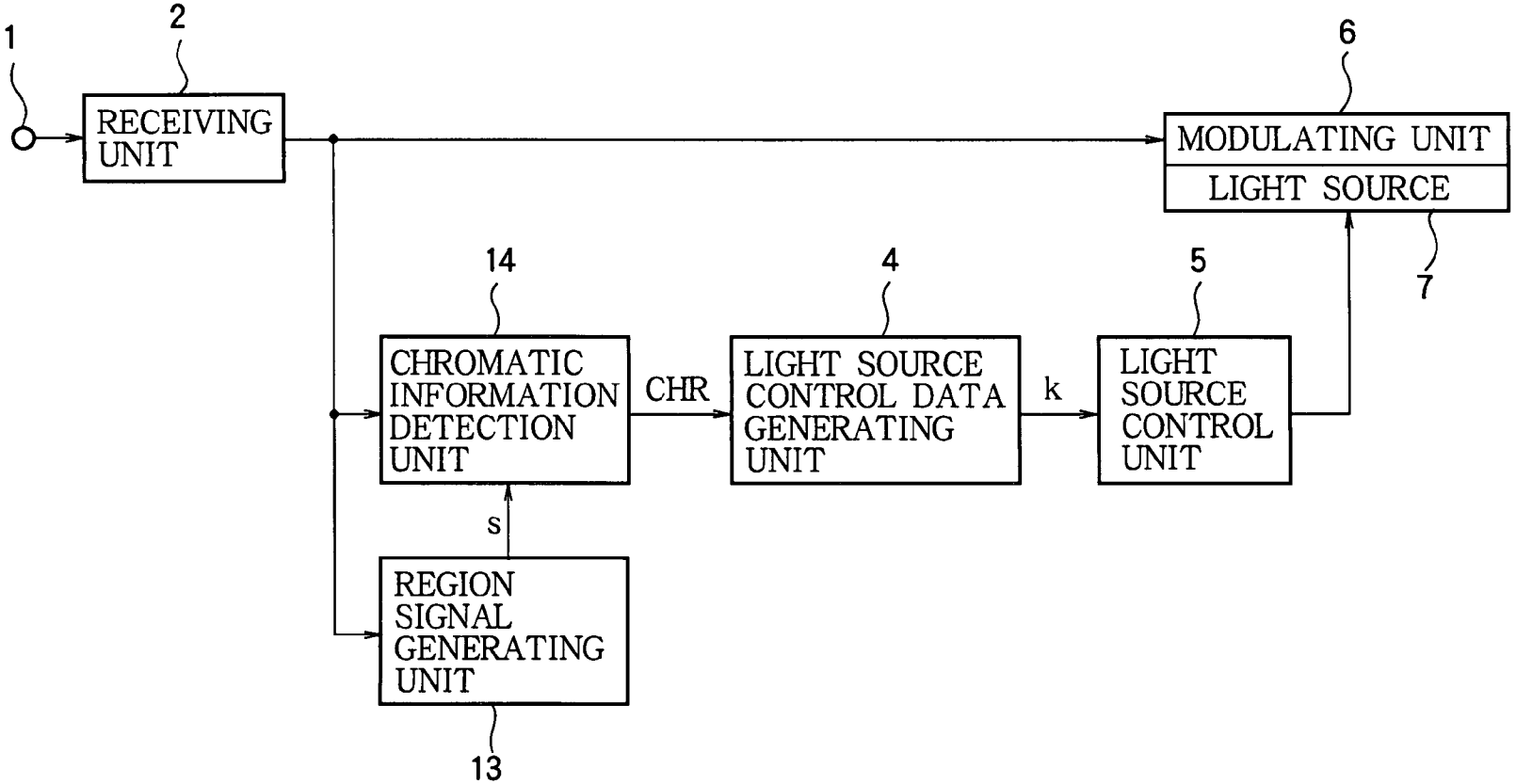
FIG. 9 is a block diagram showing the structure of an embodiment of an image display apparatus according to the present invention.
Figure 10:
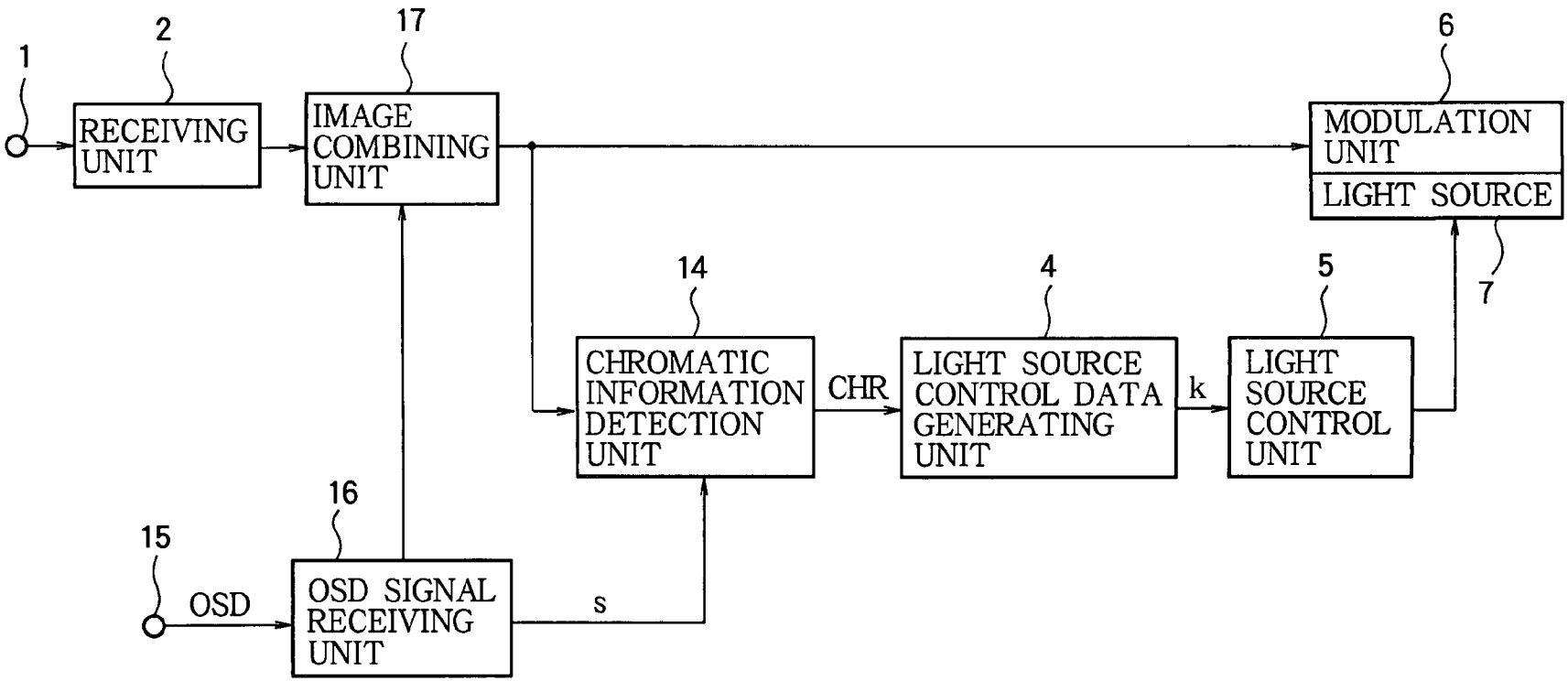
FIG. 10 is a block diagram showing the structure of an embodiment of an image display apparatus according to the present invention.
Figure 11:
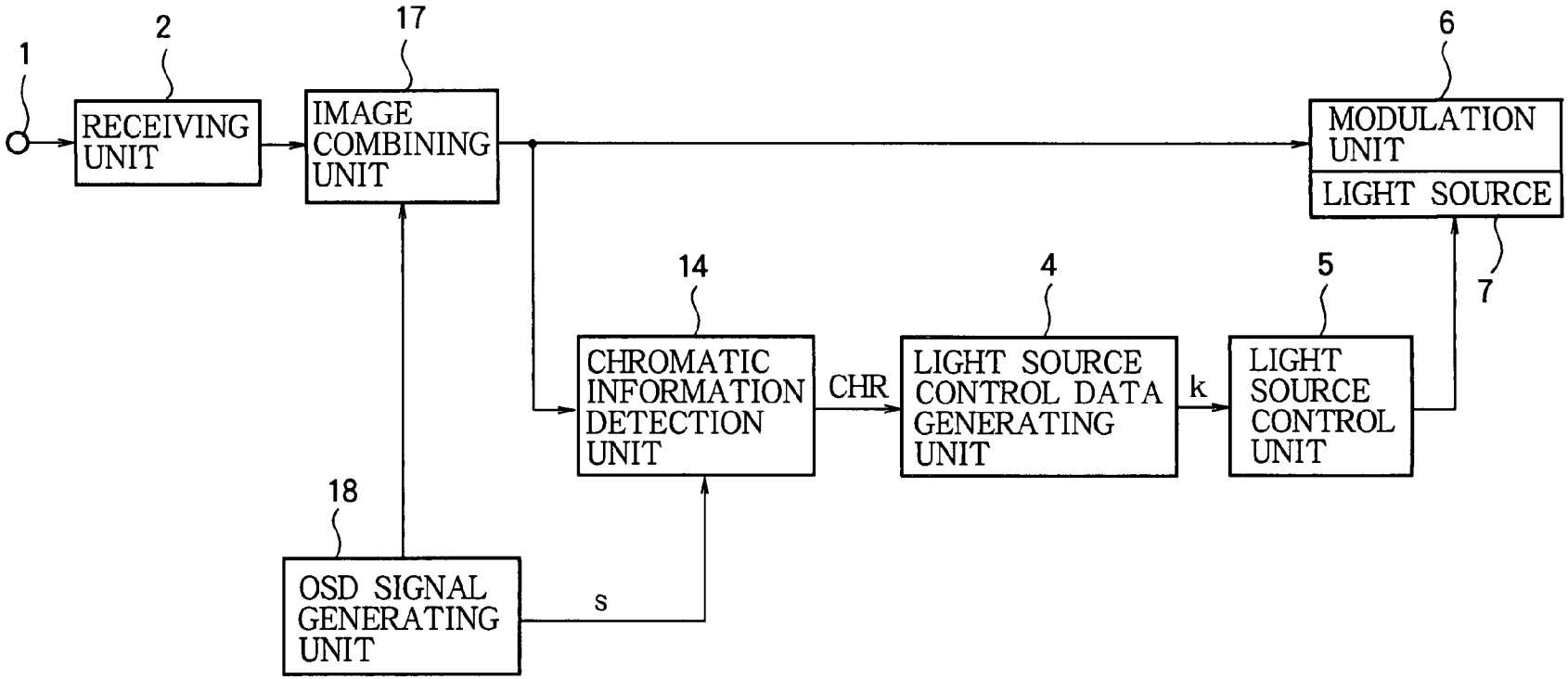
FIG. 11 is a block diagram showing the structure of an embodiment of an image display apparatus according to the present invention.
Figure 12:
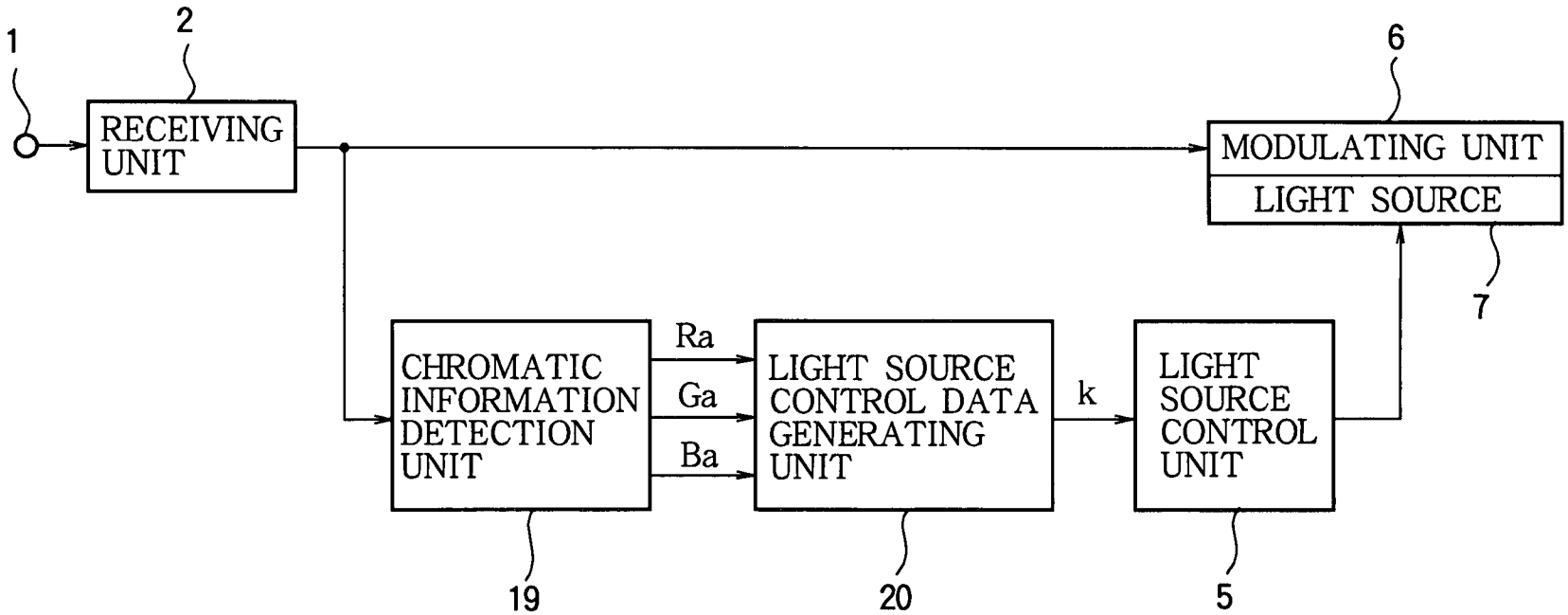
FIG. 12 is a block diagram showing the structure of an embodiment of an image display apparatus according to the present invention.
Figure 13:
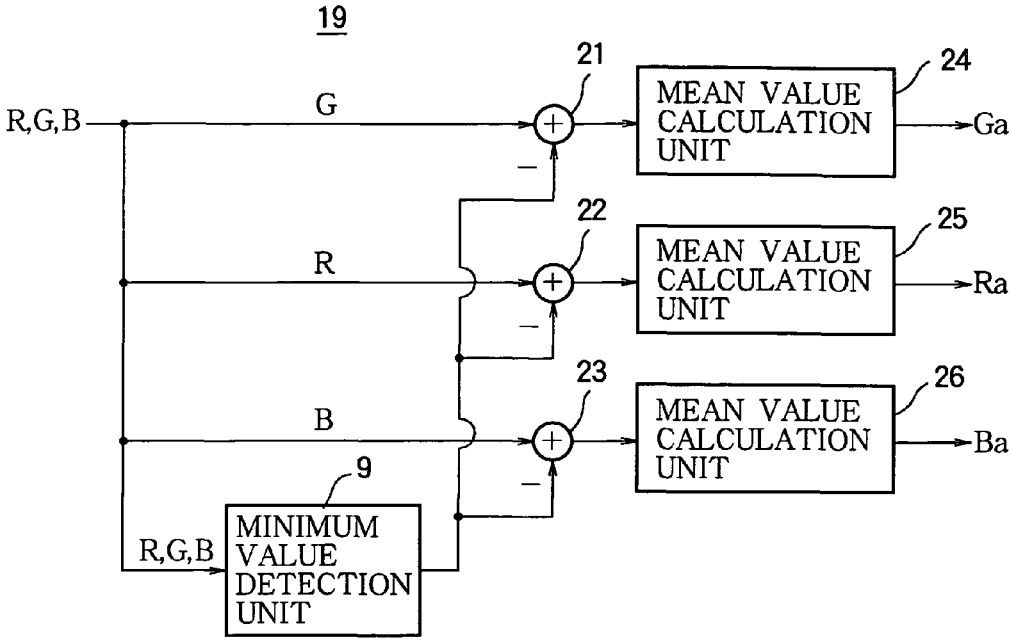
FIG. 13 is a block diagram showing the internal structure of the chromatic information detection unit.
Figure 14:
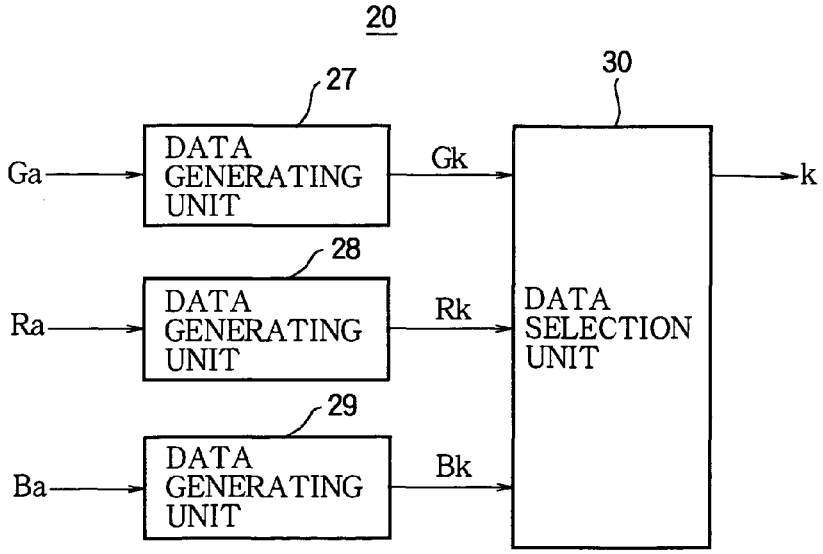
FIG. 14 is a block diagram showing the internal structure of the light source control data generating unit.
Figure 15:
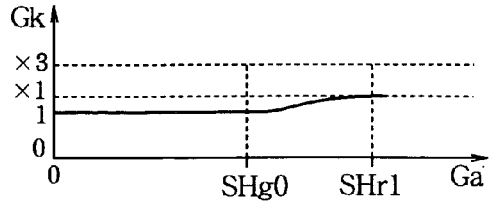
FIGS. 15(*a*) to 15(*c*) show exemplary graphs of brightness control data.
Figure 15:
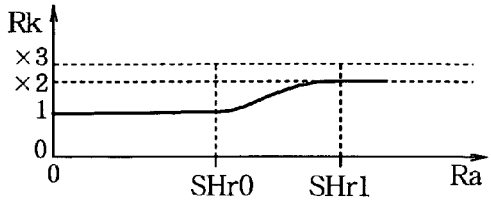
Figure 15:
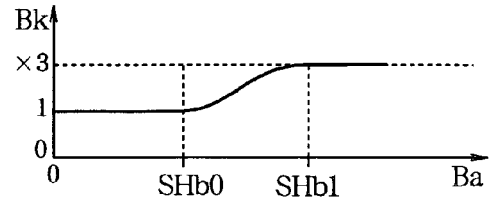
Figure 16:
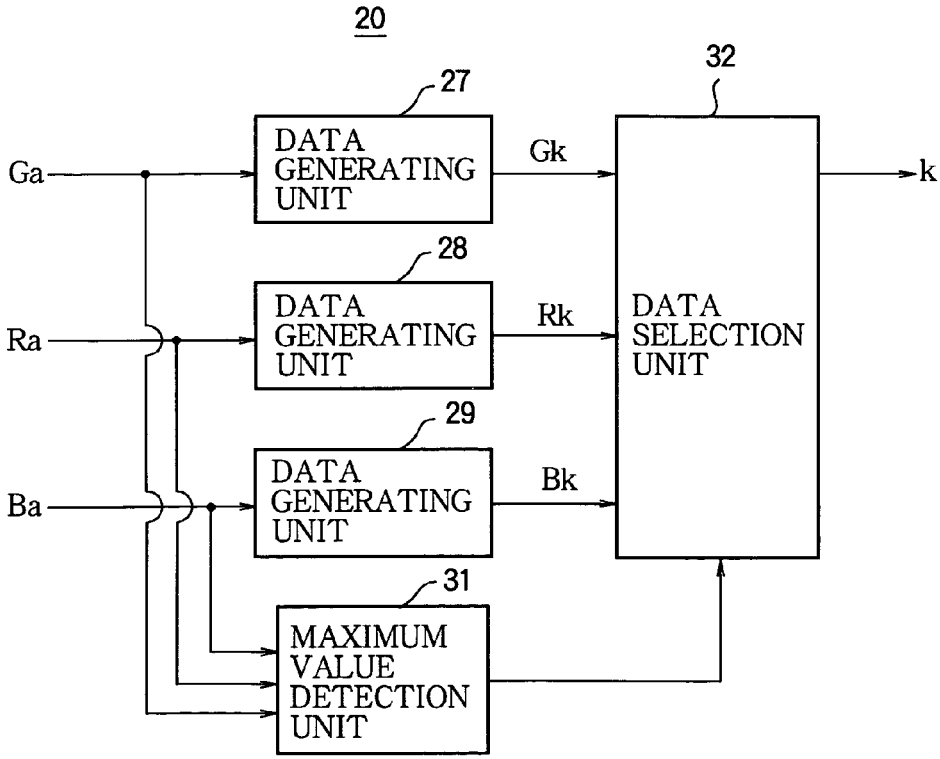
FIG. 16 is a block diagram showing the internal structure of the light source control data generating unit.
Figure 17:
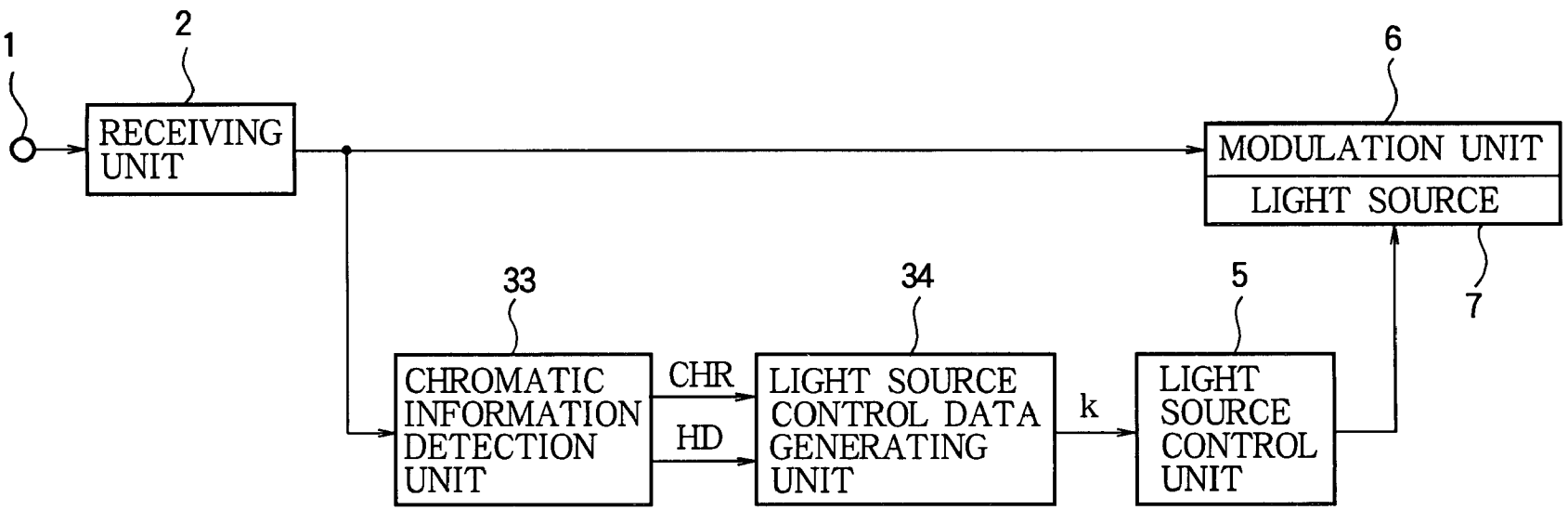
FIG. 17 is a block diagram showing the structure of an embodiment of an image display apparatus according to the present invention.
Figure 18:
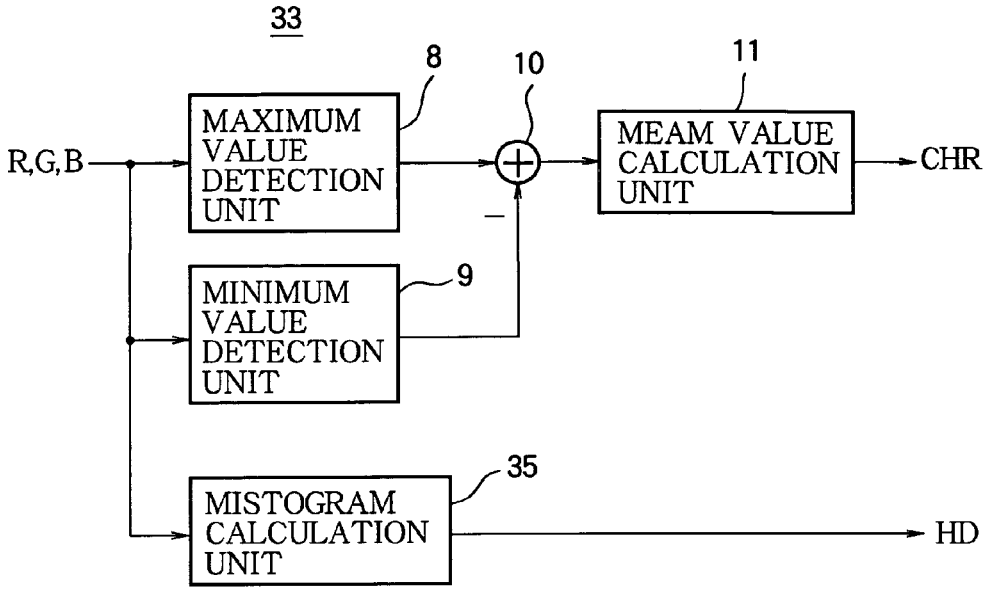
FIG. 18 is a block diagram showing an example of the internal structure of the chromatic information-detection unit.
Figure 19:
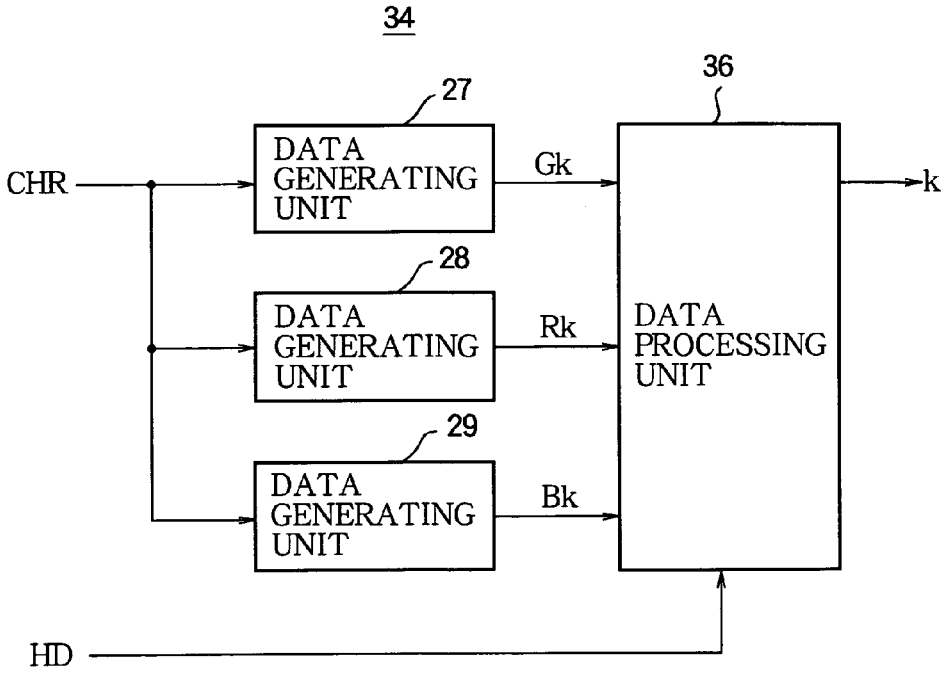
FIG. 19 is a block diagram showing an example of the internal structure of the light source control data generating unit.
Figure 20:
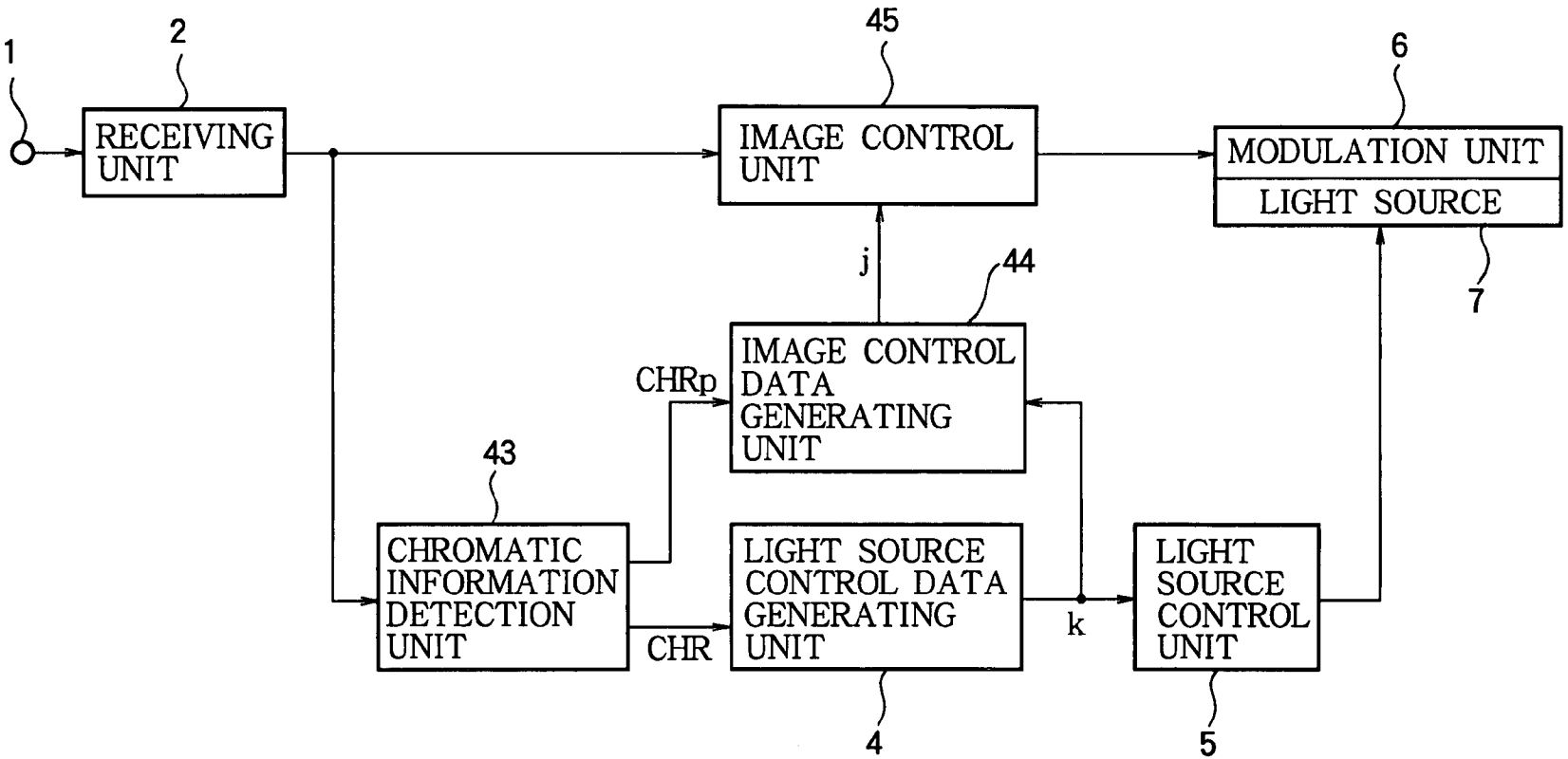
FIG. 20 is a block diagram showing the structure of an embodiment of an image display apparatus according to the present invention.
Figure 21:
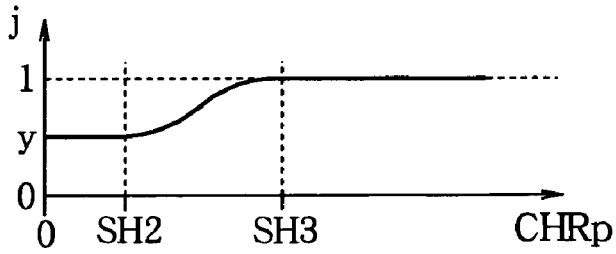
FIG. 21 shows an exemplary graph of image control data.
Figure 22:
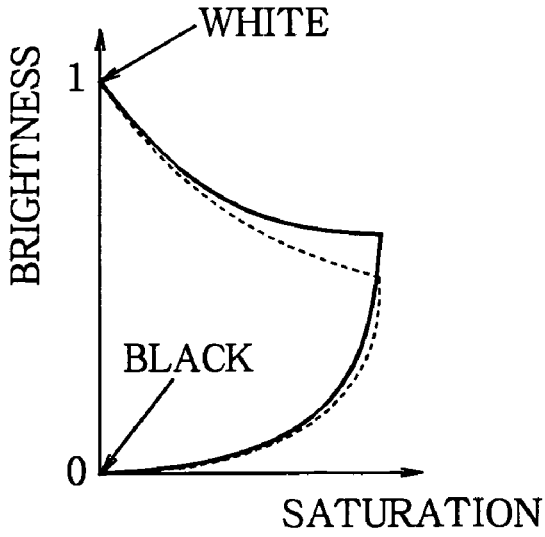
FIG. 22 illustrates an effect of the image display apparatus according to the present invention.
Figure 23:
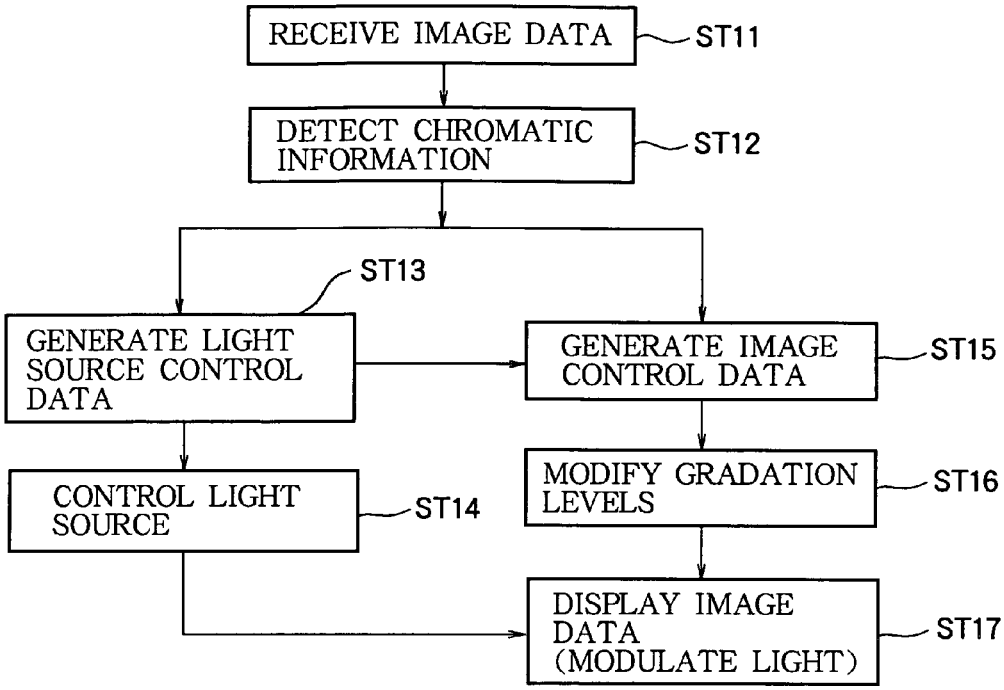
FIG. 23 is a flowchart showing processing in an image display apparatus according to the present invention.
Figure 24:
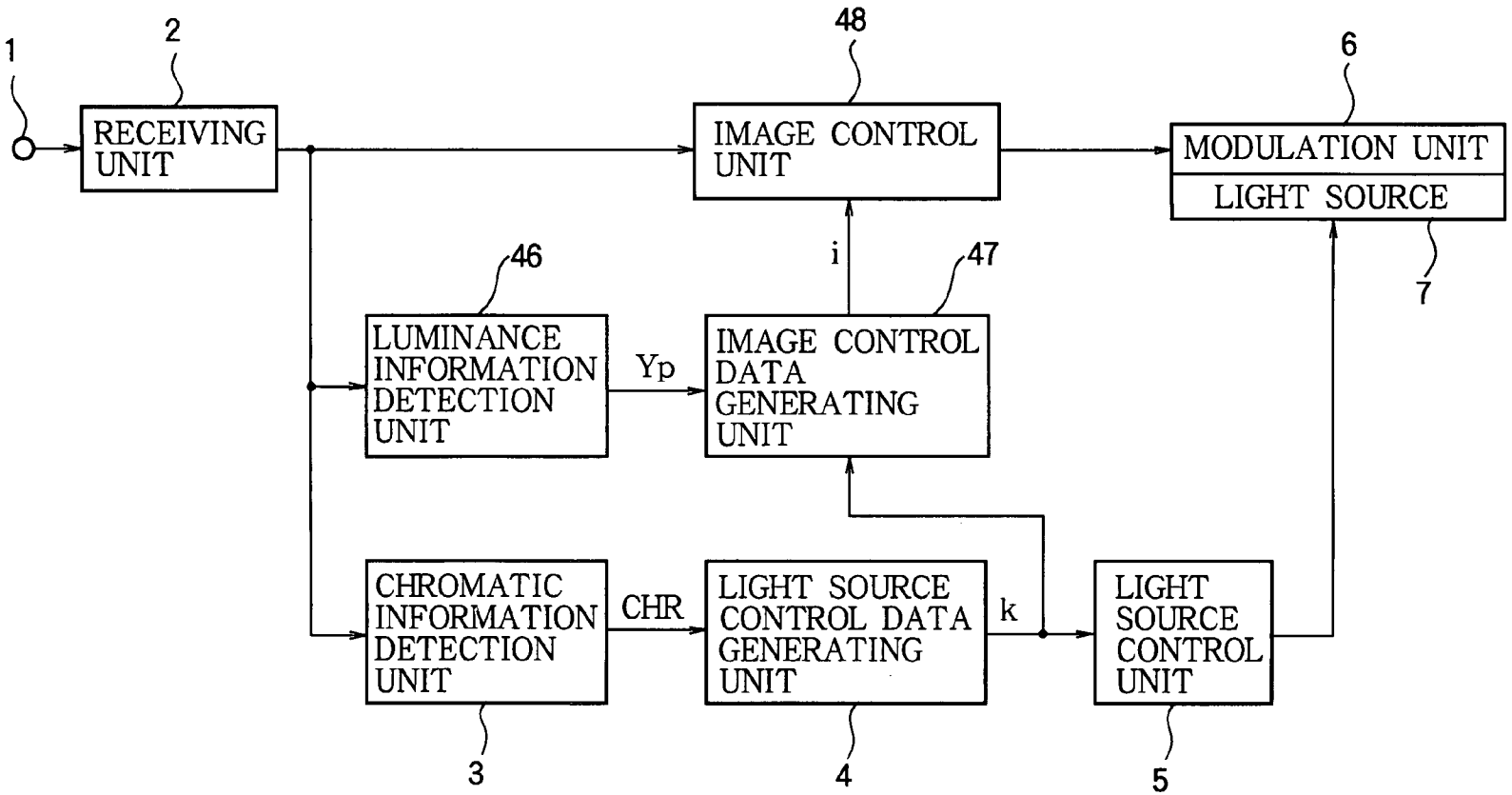
FIG. 24 is a block diagram showing the structure of an embodiment of an image display apparatus according to the present invention.
Figure 25:
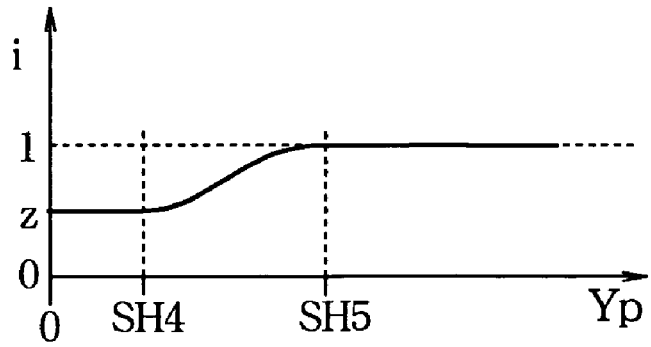
FIG. 25 shows an exemplary graph of image control data.
Figure 26:
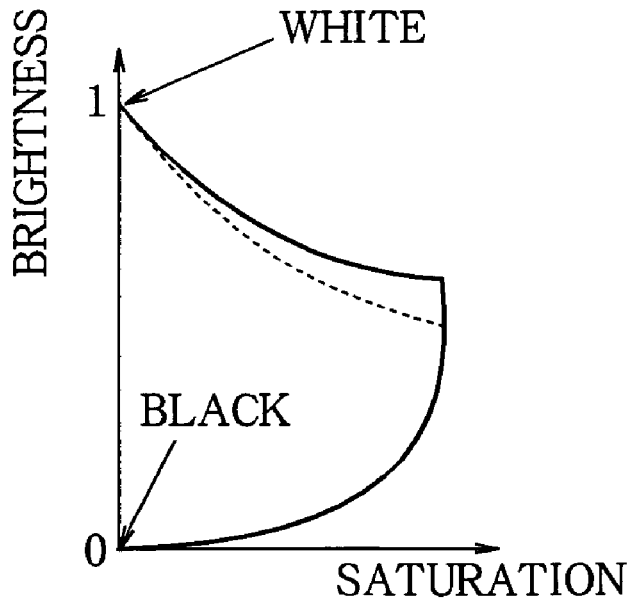
FIG. 26 illustrates an effect of the image display apparatus according to the present invention.
Figure 27:
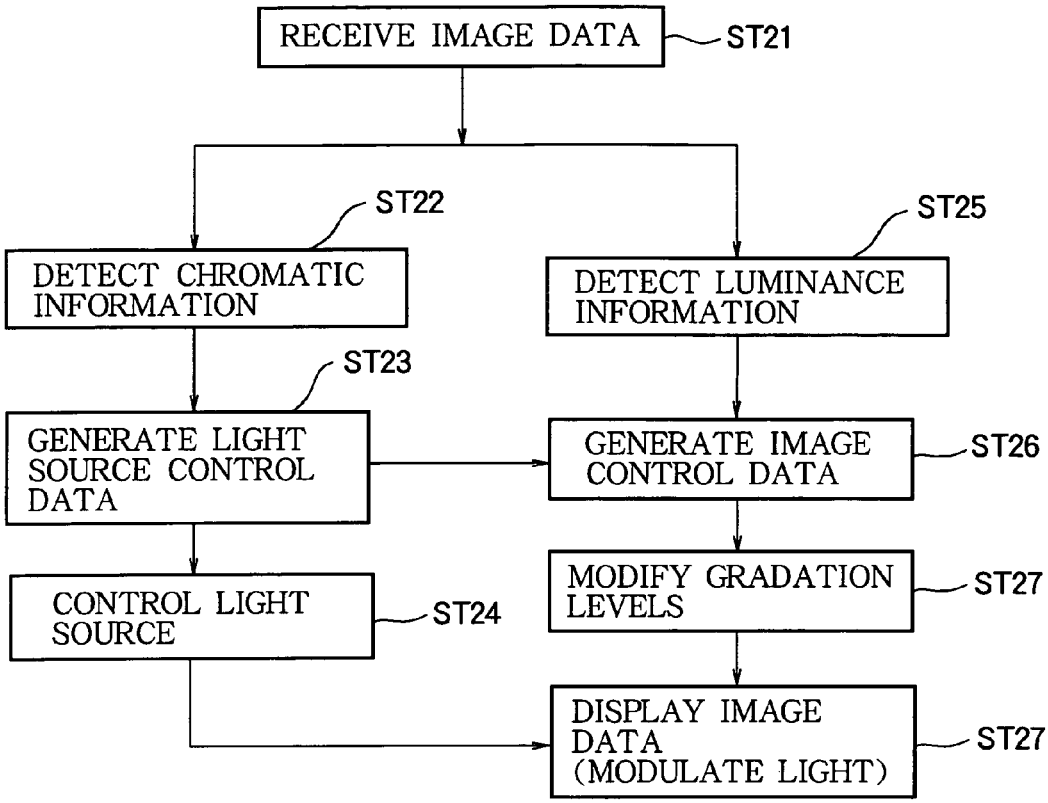
FIG. 27 is a flowchart showing processing in an image display apparatus according to the present invention.
Figure 28:
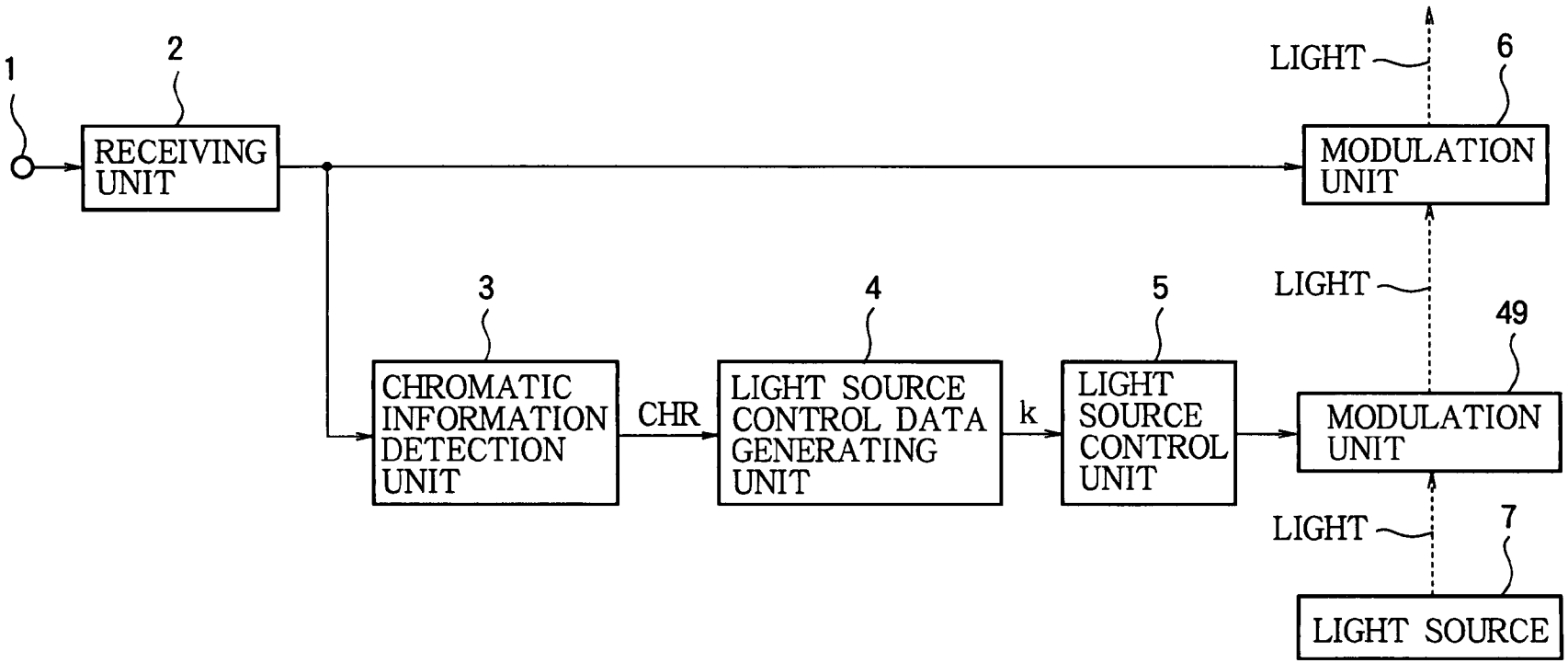
FIG. 28 is a block diagram showing the structure of an embodiment of an image display apparatus according to the present invention.
Figure 29:
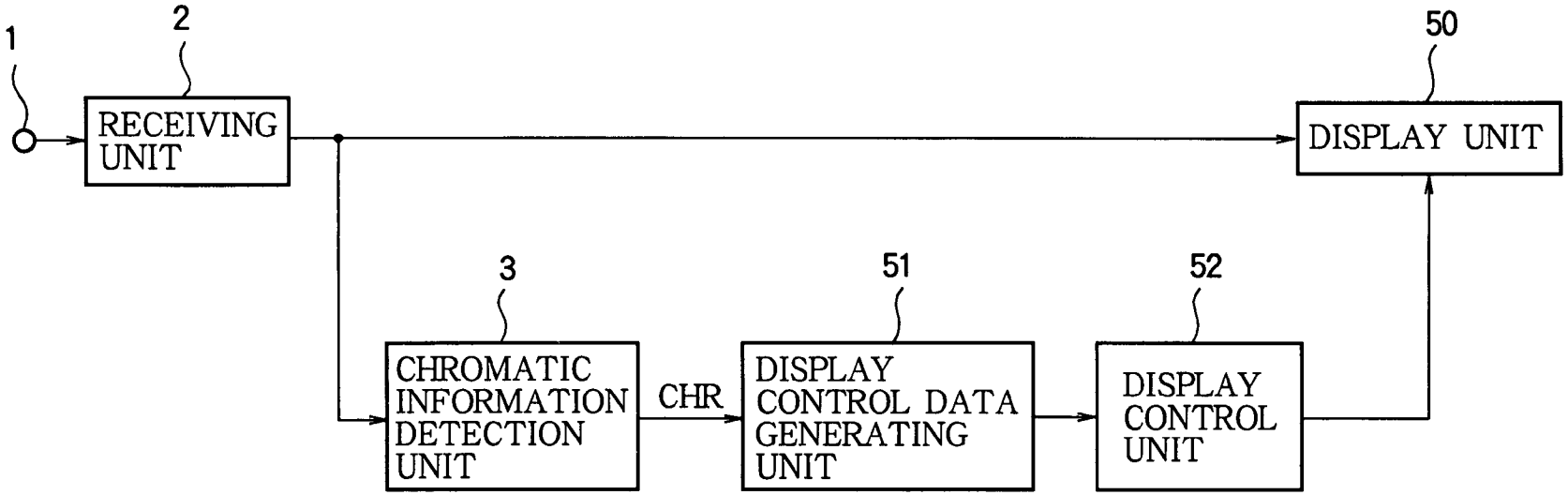
FIG. 29 is a block diagram showing the structure of an embodiment of an image display apparatus according to the present invention.
Figure 30:
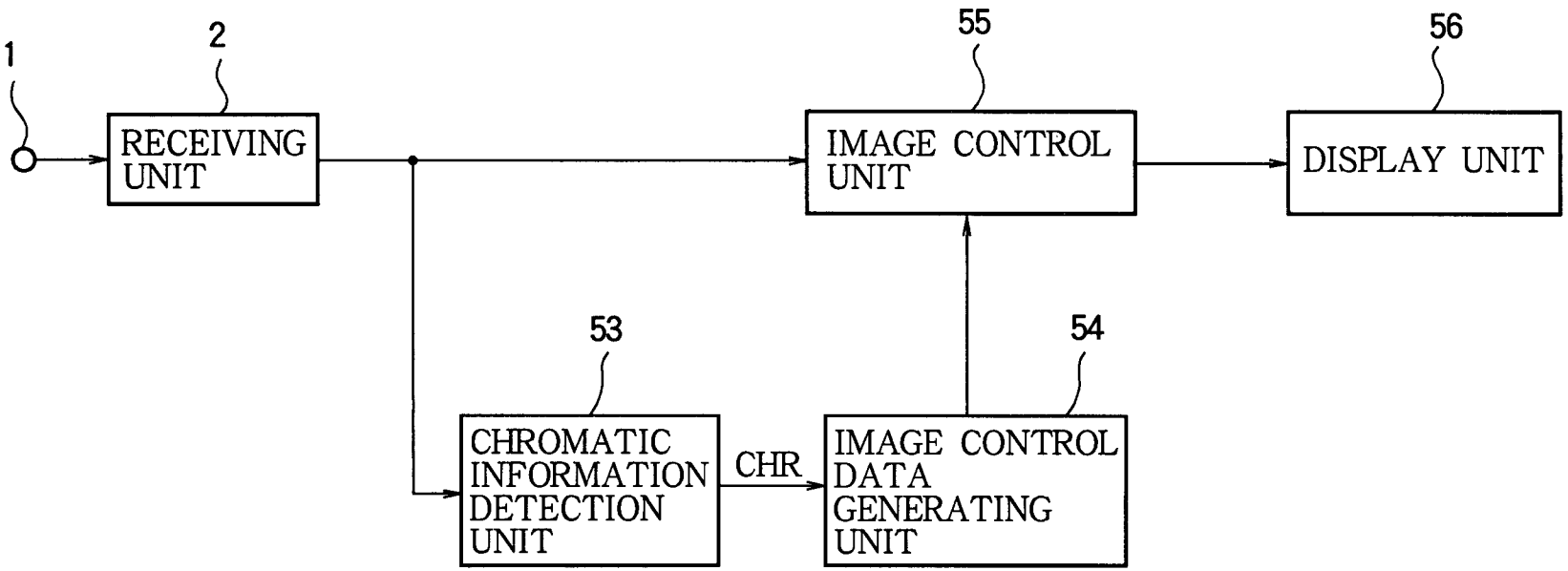
FIG. 30 is a block diagram showing the structure of an embodiment of an image display apparatus according to the present invention.
Figure 31:
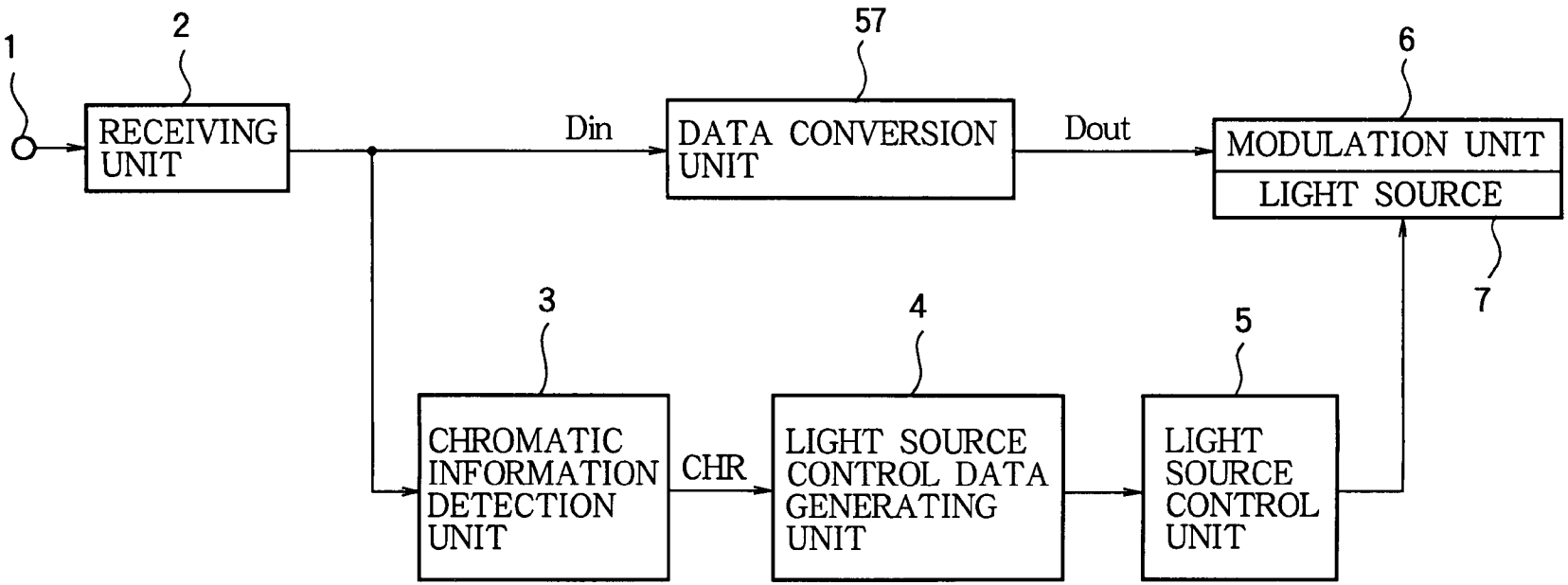
FIG. 31 is a block diagram showing the structure of an embodiment of an image display apparatus according to the present invention.
Figure 32:
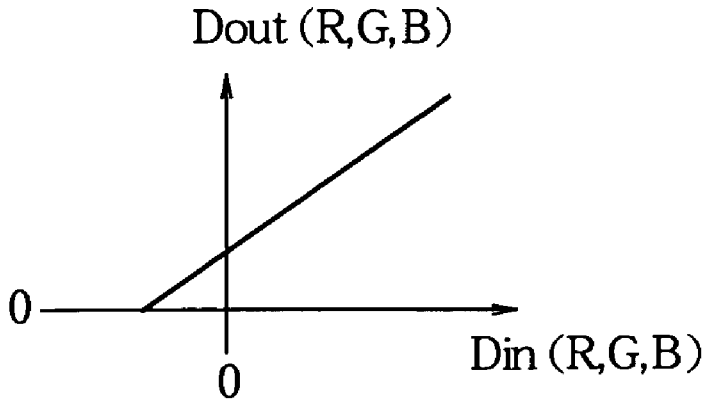
FIG. 32 shows an exemplary graph of a conversion characteristic in the data conversion unit.
Figure 33:
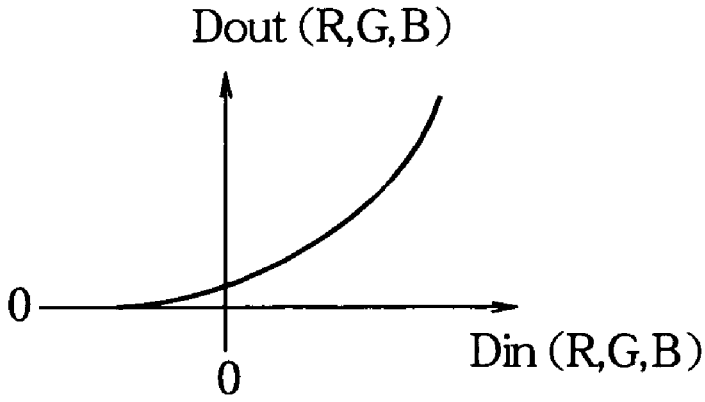
FIG. 33 shows an exemplary graph of a conversion characteristic in the data conversion unit.

2 receiving unit, 3 chromatic information detection unit, 4 light source control data generating unit, 5 light source control unit, 6 modulating unit, 7 light source

What is claimed is:

1. An image display apparatus having a light modulation unit configured to receive image data and form an image by modulating light from a light source according to the image data, the image display apparatus comprising:

a chromatic information detector configured to detect a magnitude of a chromatic component of an image expressed by the image data;

a light source control data generator configured to generate light source control data for controlling brightness of the light source according to the magnitude of the chromatic component;

a light source controller configured to control the brightness of the light source according to the light source control data, a luminance information detector configured to detect a magnitude of a luminance component in each pixel of the image expressed by the image data;

an image control data generator configured to generate image control data for modifying gradation levels of each pixel in the image expressed by the image data according to the magnitude of the luminance component and the light source control data; and an image control unit configured to modify the image data according to the image control data;

wherein the light modulation unit is configured to modulate the light from the light source according to the modified image data; and wherein the chromatic information detector includes a minimum value detection unit for detecting a minimum value of color components for each pixel and detects the magnitude of chromatic component using the minimum value.

2. The image display apparatus of claim 1, wherein the light source control data generator is configured to generate the light source control data according to the magnitude of the chromatic component in one frame or a plurality of frames of the image expressed by the image data.

3. The image display apparatus of claim 1, wherein the chromatic information detector is configured to detect the magnitude of the chromatic component in a certain region of the image expressed by the image data, and the light source control data generator is configured to generate the light source control data from the magnitude of the chromatic component in said certain region.

4. The image display apparatus of claim 1, wherein the chromatic information detector is configured to detect magnitudes of chromatic components for each of a plurality of color components, and the light source control data generator is configured to generate the light source control data from the magnitudes of the chromatic components detected for each of said color components.

5. The image display apparatus of claim 4, wherein the chromatic information detector subtracts the minimum value from values of the color components to obtain the magnitudes of the chromatic components for each of the color components.

6. The image display apparatus of claim 4, wherein the light source control data generator includes:

two or more data generating units configured to generate light source control data for each of the plurality of color components, based on the chromatic components; and a data selection unit configured to select a maximum value from among the light control data and output the selected value as the light source control data to be used for controlling the brightness of the light source.

7. The image display apparatus of claim 1, wherein the light source control unit generates the light source control data which increases the brightness of the light source when the magnitude of the chromatic component is larger than a predetermined value.

8. The image display apparatus of claim 1, wherein the chromatic information detector further includes a maximum value detection unit configured to detect a maximum value of color components for each pixel and also to detect the magnitude of the chromatic component by subtracting the minimum value from the maximum value.

9. An image display method for receiving image data and forming an image by modulating light from a light source according to the image data comprising the steps of:

detecting a magnitude of a chromatic component of an image expressed by the image data by using a minimum value of color components for each pixel;

generating light source control data for controlling brightness of the light source according to the magnitude of the chromatic component;

controlling the brightness of the light source according to the light source control data;

detecting a magnitude of a luminance component in each pixel of the image expressed by the image data;

generating image control data for modifying gradation levels of each pixel in the image expressed by the image data according to the magnitude of the luminance component and the light source control data; and modifying the image data according to the image control data;

wherein the light from the light source is modulated according to the modified image data.

10. The image display method of claim 9, wherein the light source control data are generated according to the magnitude of the chromatic component in one frame or a plurality of frames of the image expressed by the image data.

11. The image display method of claim 9, wherein the magnitude of the chromatic component is detected in a certain region of the image expressed by the image data, and the light source control data are generated from the magnitude of the chromatic component in said certain region.

12. The image display method of claim 9, wherein magnitudes of the chromatic components are detected for each of a plurality of color components, and the light source control data are generated from the magnitudes of the chromatic components detected for each of said color components.

13. The image display method of claim 12, wherein the minimum value is detected from values of the color components to obtain the magnitudes of the chromatic components for each of the color components.

14. The image display method of claim 12, wherein the step of generating light source control data includes:

generating light source control data for each of the plurality of color components based on the chromatic components; and selecting a maximum value from among the light control data; and where said step of controlling the brightness of the light source includes using the selected value for controlling the brightness of the light source.

15. The image display method of claim 9, wherein the light source control data is so generated as to increase the brightness of the light source when the magnitude of the chromatic component is larger than a predetermined value.

16. The image display method of claim 9, wherein the chromatic information detector further includes a maximum value detection unit configured to detect a maximum value of color components for each pixel and also to detect the magnitude of the chromatic component by subtracting the minimum value from the maximum value of color components for each pixel.

17. An image display apparatus having a light modulation unit configured to receive image data and form an image by modulating light from a light source according to the image data, the image display apparatus comprising:

a chromatic information detector configured to detect a magnitude of a chromatic component of an image expressed by the image data;

a light source control data generator configured to generate light source control data for controlling brightness of the light source according to the magnitude of the chromatic component; and a light source controller configured to control the brightness of the light source according to the light source control data, wherein the chromatic information detector includes a minimum value detection unit for detecting a minimum value of color components for each pixel and detects the magnitude of chromatic component using the minimum value, wherein the chromatic information detector is configured to detect magnitudes of chromatic components for each of a plurality of color components, wherein the light source control data generator is configured to generate the light source control data from the magnitudes of the chromatic components detected for each of said color components, and wherein the chromatic information detector subtracts the minimum value from values of the color components to obtain the magnitudes of the chromatic components for each of the color components.

* * * * *